US005246819A

United States Patent [19]

Yoshida et al.

[11] Patent Number: 5,246,819

[45] Date of Patent: * Sep. 21, 1993

[54] METHOD FOR PROCESSING SILVER HALIDE COLOR PHOTOGRAPHIC MATERIAL

[75] Inventors: Kazuaki Yoshida; Takatoshi Ishikawa, both of Minami-ashigara, Japan

[73] Assignee: Fuji Photo Film Co., Ltd., Kanagawa, Japan

[ * ] Notice: The portion of the term of this patent subsequent to Dec. 31, 2008 has been disclaimed.

[21] Appl. No.: 735,180

[22] Filed: Jul. 25, 1991

Related U.S. Application Data

[63] Continuation of Ser. No. 649,256, Jan. 31, 1991, abandoned, which is a continuation of Ser. No. 291,014, Dec. 28, 1988, abandoned.

[30] Foreign Application Priority Data

Dec. 28, 1987 [JP] Japan ..... 62-335566

[51] Int. Cl.[5] ..... G03C 7/30

[52] U.S. Cl. ..... 430/386; 430/387; 430/435; 430/467; 430/490; 430/543; 430/558

[58] Field of Search ..... 430/386, 387, 435, 467, 430/490, 543, 558

[56] References Cited

U.S. PATENT DOCUMENTS

| | | | |
|---|---|---|---|
| 4,565,774 | 1/1986 | Kajiwara et al. | 430/382 |
| 4,766,057 | 8/1988 | Sakai | 430/386 |
| 4,769,313 | 9/1988 | Fujimoto et al. | 430/558 |
| 4,797,351 | 1/1989 | Ishikawa et al. | 430/399 |
| 4,798,783 | 1/1989 | Ishikawa et al. | 430/372 |
| 4,800,153 | 1/1989 | Morimoto et al. | 430/372 |
| 4,801,521 | 1/1989 | Ohki et al. | 430/380 |
| 4,818,673 | 4/1989 | Ueda et al. | 430/566 |
| 4,833,068 | 5/1989 | Ohki et al. | 430/484 |
| 4,851,326 | 7/1989 | Ishikawa et al. | 430/380 |
| 4,892,804 | 1/1990 | Vincent et al. | 430/138 |
| 4,910,124 | 3/1990 | Furutachi | 430/399 |
| 4,920,041 | 4/1990 | Ohki et al. | 430/467 |

FOREIGN PATENT DOCUMENTS

| | | |
|---|---|---|
| 173203 | 3/1986 | European Pat. Off. . |
| 59-232342 | 12/1984 | Japan . |
| 61-70552 | 4/1986 | Japan . |

OTHER PUBLICATIONS

Kodak, "Processing Techniques, Chemicals and Formulas," pp. 1-58, 1969.

Partial Translations of JP 30250/87, JP 246054/87, JP 249149/87 and JP 257156/87.

Copending Application 07/261458 filed on Oct. 29, 1988, Yoshida et al.

*Primary Examiner*—Hoa V. Le

*Attorney, Agent, or Firm*—Sughrue, Mion, Zinn, Macpeak & Seas

[57] ABSTRACT

In accordance with the present invention a method for continuously processing a silver halide color photographic material with a color developer containing at least one aromatic primary amine color-developing agent is disclosed. The silver halide color photographic material at least one of the layers of which contains a silver halide emulsion of a high chloride comprising 80 mol % or over of silver chloride is processed, after exposure to light, with the replenishing amount of the color developer being 20 to 120 ml per $m^2$ of the silver halide photographic material. The silver halide photographic material contains at least one of pyrazoloazole magenta couplers.

16 Claims, No Drawings

METHOD FOR PROCESSING SILVER HALIDE COLOR PHOTOGRAPHIC MATERIAL

This is a continuation of application Ser. No. 07/649,256 filed Jan. 31, 1991 now abandoned, which is a continuation of application Ser. No. 07/291,014 filed Dec. 28, 1988 now abandoned.

FIELD OF THE INVENTION

The present invention relates to a method of processing silver halide color photographic materials, and in particular, a method of processing silver halide color photographic materials in which the replenishing amount of the color developer is reduced considerably.

BACKGROUND OF THE INVENTION

Processing a silver halide color photographic material basically comprises two steps of color development (for a color reversal material, a black-and-white development precedes this), and desilvering, and the desilvering step comprises a bleaching step and a fixing step, or a monobath bleach-fixing step that may be used alone or in combination with a bleaching step and a fixing step. If necessary additional processing steps may be added, such as a washing step, a stopping step, a stabilizing step, and a pretreatment step for the acceleration of development.

In the color development step, silver halide that has been exposed to light is reduced to silver, and at the same time the oxidized primary amine color-developing agent reacts with a coupler to form a dye. In this process halide ions resulting from the decomposition of the silver halide dissolve into the developing solution and accumulate therein. On the other hand, the color-developing agent is consumed by the above-mentioned reaction with the coupler. Further, other components in the color developer will be held in the photographic material and carried over, so that the concentrations of components in the developing solution lower gradually. Therefore, in a development method that involves continuously processing a large amount of a silver halide photographic material by, for example, an automatic-developing processor, in order to avoid a change the in finished characteristics of the development due to a change in the concentrations of the components, a means of keeping the concentrations of the components of the color developer in certain ranges is required.

For instance, if the influence of the condensation of a component that will be consumed, such as developing agents and preservatives, is small, generally its concentration in the replenisher is previously made high in some cases a material that will elute and that has an effect of restraining development is contained in a lower concentration in a replenisher, or is not contained in the replenisher. In other cases a compound may be contained in a replenisher in order to remove the influence of a material that will elute. Further, in other cases, for example, the pH, the concentration of the alkali, or the concentration of a chelating agent is adjusted. As measures for them, generally a method of replenishing with replenishers is used that will supply insufficient components and dilute the increased components. The replenishment with the replenishers, however, necessarily results in a large amount of overflow, which has caused big problems concerning economics and the pollution.

In recent years, for the purpose of saving resources and lowering the pollution, it has been earnestly desired to reduce the replenishing amount of the color developer and also to make the developing process rapid. However, if the replenishing amount of a color developer is simply lowered, exudates from the photographic material, in particular bromide ions, which are a strong development restrainer, and organic compounds accumulate, resulting in a problem that lowers the development activity, retarding the speed of development.

To solve this problem a technique of accelerating the development is required, and many techniques for making the development rapid that enable the replenishing amount to be lowered have been studied. It is known as one of such techniques, for example, to increase the pH and the processing temperature of the color developer, thereby making the development rapid. However, that technique causes such serious problems as that fogging is high, the stability of the developing solution is lowered, and the fluctuation of the photographic characteristics in continuous processing increases. As another technique for the acceleration, the technique of adding various development accelerators is disclosed, but its effect has been inadequate and unsatisfactory.

For the purpose of lowering the accumulation of bromide ions, which are a strong development restrainer, thereby intending to make the development rapid, JP-A ("JP-A" means unexamined published Japanese patent application) Nos. 95345/1983, 232342/1984, and 70552/1986, and International Publication No. WO 04534/1987 disclose methods wherein silver halide photographic materials having high contents of silver chloride are used, and the methods are considered as effective means of lowering the replenishing amount of the developer without reducing the speed of the development. However, it was found that these methods were impractical because such new problems arose as that when the replenishing amount of the developer was lowered and the process was carried out continuously, although the speed of the development was not reduced, along with the continuous processing the photographic characteristics, in particular the minimum density, the maximum density, and the sensitivity of the magenta color layer formed, fluctuated conspicuously, and in addition, the image-lasting quality after the processing was deteriorated, and in particular the yellow stain increased considerably.

On the other hand, JP-A Nos. 30250/1987, 246054/1987, 249149/1987, and 257156/1987 describe methods of processing silver halide photographic materials that contain a pyrazoloazole magenta coupler having the formula (I) and that comprise silver chloride or silver chlorobromide, and according to the technique disclosed therein these methods enable processing to be carried out in a rapid manner, the maximum density of the magenta color formed layer is high, fogging is low, and the color reproduction quality is excellent. However, there is no disclosure therein related to continuous processing, much less a description concerning the problems discussed above, which problems arise when the replenishing amount of a developer is decreased considerably and concerning measures of solving such problems. Therefore from the disclosures one cannot infer the technique of the present invention.

At present, although the replenishing amount of a color developer varies a little depending on the photographic material to be developed, generally it is required that the replenishing amount is on the order of 180 to 1,000 ml per $m^2$ of the photographic material to be processed. This is because if the replenishing amount is further lowered, while avoiding reduction of the speed of development, quite serious problems occur, that is, the photographic characteristics, in particular the maximum density, the minimum density, and the density of the magenta color layer formed, fluctuate greatly, the image-lasting quality after the processing is marred, and in particular the yellow stain increases, and no technique has been found that is able to solve these problems.

BRIEF SUMMARY OF THE INVENTION

Therefore, the first object of the present invention is to provide a developing method wherein the replenishing amount of the color developer can be lowered remarkably without marring the rapidness of the process, and the photographic characteristics, in particular the minimum density, the maximum density, and the sensitivity of the magenta color layer formed, change less even in a continuous process.

The second object of the present invention is to provide a processing method wherein deterioration of the image-lasting quality after the processing, in particular an increase in the yellow stain, is prevented, even if the the replenishing amount of the color developer is decreased remarkably.

Other and further objects, features, and advantages of the invention will appear more fully in the following description.

DETAILED DESCRIPTION OF THE INVENTION

The inventors have conducted various studies and have found that the above objects can be attained by providing the method described below. That is, the present invention provides a method of processing a silver halide color photographic material with a color developer containing at least one aromatic primary amine color-developing agent, characterized in that a silver halide color photographic material that has at least one layer of a high-silver-chloride emulsion comprising 80 mol % or over of silver chloride, and which contains at least one of pyrazoloazole magenta couplers represented by the following formula (I):

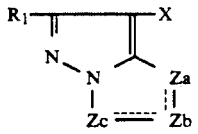

Formula (I)

wherein $R_1$ represents a hydrogen atom or a substituent; X represents a hydrogen atom or a group that can be split-off by a coupling reaction with the oxidation product of the aromatic primary amine-developing agent; Za, Zb, and Zc each represent methine, a substituted methine, =N—, or —NH—; one of the Za—Zb bond and the Zb—Zc bond is a double bond, and the other is a single bond; and when the Zb—Zc bond is a carbon-carbon double bond, it may be part of an aromatic ring, and the compound may form a dimer or a higher polymer via $R_1$ or X; and when Za, Zb, or Zc is a substituted methine, the compound may form a dimer or a higher polymer via said substituted methine, is processed, after exposure to light, with the color developer wherein the replenishing amount of the color developer is in the amount of 20 to 120 ml per $m^2$ of said silver halide photographic material.

The process as disclosed in the present invention, wherein the replenishing amount of the color developer is reduced to the amount of 20 to 120 ml per $m^2$ of a photographic material without reducing the speed of the process by using a high-silver-chloride color photographic material having a silver chloride content of 80 mol % or over, could not been carried out in practice in the prior art when the process was effected continuously. Because problems arose, that is, because the photographic characteristics, in particular, the maximum density, the minimum density, and the sensitivity of the magenta color layer formed fluctuated remarkably, the image-lasting quality after the processing was marred, and in particular the yellow stain increased.

However, it has unexpectedly been found that as in the present invention, by using a high-silver-chloride color photographic material that contains a pyrazoloazole magenta coupler represented by formula (I) and that has a silver chloride content of 80 mol % or over, if the replenishing amount of a color developer is reduced to from 20 to 120 ml per $m^2$ of the photographic material, the fluctuation of the maximum density, the minimum density, and the sensitivity of the magenta color layer formed is very small, the image-lasting quality after the processing can be improved, and in particular the yellow stain can be remarkably prevented.

Although quick-processing methods that use a high-silver-chloride photographic material comprising 80 mol % or over of silver chloride are disclosed in JP-A Nos. 95345/1983, 232342/1984, and 70552/1986, and International Publication No. WO 04534/1987, these processing methods are carried out in the absence of a coupler having formula (I), and in these publications there is no disclosure concerning the above-discussed problems that arise when the replenishing amount of the developer is remarkably reduced, nor is there a description concerning measures to solve such problems, which therefore do not lead to the inference of present invention. Further, although in JP-A Nos. 30250/1987, 246054/1987, 249149/1987, and 257156/1987, methods of processing silver halide photographic materials that contain a coupler having formula (I) and that comprise silver chloride or silver chlorobromide are disclosed, there is no disclosure concerning a case wherein the photographic material is processed continuously, nor is there a description concerning problems in a case wherein the process is carried out continuously with the replenishing amount of the color developer decreased remarkably. Further, these publications do not describe whether the problems discussed above can be solved. Therefore one cannot infer the technique of the present invention from these publications.

The compound represented by formula (I) will now be described in detail.

The term "polymers" represented by formula (I) means compounds having two or more residues derived from formula (I) in one molecule, including dimers (bis-form) and polymer couplers. Herein, a polymer coupler may be a homopolymer made up of a monomer (preferably having a vinyl group, and hereinafter referred to as vinyl monomer) having a moiety represented by formula (I), or a copolymer of such a monomer with a non-color-forming ethylene monomer that will not couple with the oxidation product of an aromatic primary amine-developing agent.

The compound represented by formula (I) is a 5-membered ring/5-membered ring condensed nitrogen heterocyclic-type coupler, and its color-forming mother nucleus exhibits an aromatic character isoelectronic to naphthalene, and it has a chemical structure that is commonly called azapentalene. Preferable compounds of the couplers represented by formula (I) are 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles, and 1H-pyrazolo[1,5-a]benzimidazoles, which can be represented by formulae (II), (III), (IV), (V), (VI) and (VII). Particularly preferable compounds of these are those represented by formula (II) and (V).

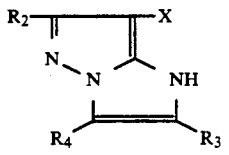
(II)

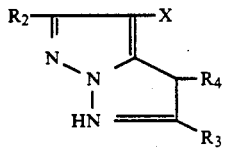
(III)

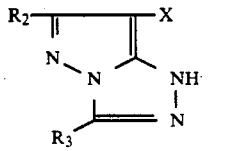
(IV)

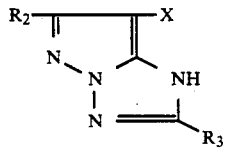
(V)

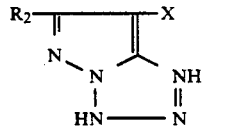
(VI)

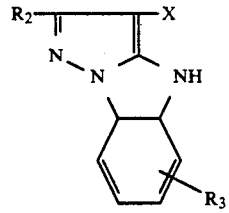
(VII)

$R_2$, $R_3$, and $R_4$ in formulae (II) to (VII) each represent a hydrogen atom, an halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group, and X represents a hydrogen atom, a halogen atom, a carboxy group, or a group that links to the carbon atom in the coupling position through an oxygen atom, a nitrogen atom, or a sulfur atom, and that will be split-off by a coupling reaction.

The case wherein $R_2$, $R_3$, $R_4$, or X is a divalent group to form a dimer is also included in the present invention. When a moiety represented by one of formulae (II) to (VII) is present in a vinyl monomer, $R_2$, $R_3$, or $R_4$ represents simply a bond or a linking group, through which said moiety and the vinyl group are bonded.

More particularly, $R_2$, $R_3$, or $R_4$ represents a hydrogen atom, a halogen atom (e.g., chlorine and bromine atoms), an alkyl group (e.g., methyl, propyl, t-butyl, trifluoromethyl, tridecyl, 3-(2,4-di-t-amylphenoxy)propyl, 2-dodecyloxyethyl, 3-phenoxypropyl, 2-hexylsulfonylethyl, cyclopentyl, and benzyl), an aryl group (e.g., phenyl, 4-t-butylphenyl, 2,4-di-t-amylphenyl, and 4-tetradecaneamidophenyl), a heterocyclic group (e.g., 2-furyl, 2-thienyl, 2-pyrimidinyl, and 2-benzothiazolyl), a cyano group, an alkoxy group (e.g., methoxy, ethoxy, 2-methoxyethoxy, 2-dodecyloxyethoxy, and 2-methanesulfonylethoxy), an aryloxy group (e.g., phenoxy, 2-methylphenoxy, and 4-t-butylphenoxy), a heterocyclic oxy group (e.g., 2-benzimidazolyloxy), an acyloxy group (e.g., acetoxy and hexadecanoyloxy), a carbamoyloxy group (e.g., N-phenylcarbamoyloxy and N-ethylcarbamoyloxy), a silyloxy group (e.g., trimethylsilyloxy), a sulfonyloxy group (e.g., dodecylsulfonyloxy), an acylamino group (e.g., acetamido, benzamido, tetradecaneamido, α-(2,4-di-t-amylphenoxy)-butyramido, γ-(3-t-butyl-4-hydroxyphenoxy)-butyramido, and α-{4-(4-hydroxyphenylsulfonyl)-phenoxy}decaneamido), an anilino group (e.g., phenylamino, 2-chloroanilino, 2-chloro-5-tetradecaneamidoanilino, 2-chloro-5-dodecyloxycarbonylanilino, N-acetylanilino, and 2-chloro-5-{α-(3-t-butyl-4-hydroxyphenoxy)dodecaneamido}anilino), a ureido group (e.g., phenylureido, methylureido, and N,N-dibutylureido), an imido group (e.g., N-succinimido, 3-benzylhdantoinyl, and 4-(2-ethylhexanoylamino)-phthalimido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecaneamidophenylthio), a heterocyclic thio group (e.g., 2-benzothiazolylthio), an alkoxycarbonylamino group (e.g., methoxycarbonylamino and tetradecyloxycarbonylamino), an aryloxycarbonylamino group (e.g., phenoxycarbonylamino, 2,4-di-tert-butylphenoxycarbonylamino), a sulfonamido group (e.g., methanesufonamido, hexadecanesulfonamido, benzenesulfonamido, p-toluenesulfonamido, octadecanesulfonamido, and 2-methyloxy-5-t-butylbenzenesulfonamido), a carbamoyl group (e.g., N-ethylcarbamoyl, N,N-dibutylcarbamoyl, N,N-dibutylcarbamoyl, N-(2-dodecyloxyethyl)carbamoyl, N-methyl-N-dodecylcarbamoyl, and N-{3-(2,4-di-tert-amylphenoxy)propyl}carbamoyl), an acyl group (e.g., acetyl, (2,4-di-tert-amylphenoxy)acetyl, and benzoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), a sulfinyl group (e.g., octansulfinyl, dodecylsulfinyl, and phenylsulfinyl), an alkoxycarbonyl group (e.g., methoxycarbonyl, butyloxycarbonyl, dodecylcarbonyl, and octadecylcarbonyl), or an aryloxycarbonyl group (e.g., phenyloxycarbonyl and 3-pentadecyloxycarbonyl), and X represents a hydrogen atom, a halogen atom (e.g., chlorine, bromine, and iodine atoms), a carboxyl group, a group that links through an oxygen atom (e.g., acetoxy, propanoyloxy, benzoyloxy, 2,4-dichlorobenzoyloxy, ethoxyoxyazoyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenetyloxy, 2-phenoxyethoxy, 5-phenyltetrazolyloxy, and 2-benzothiazolyloxy), a group that links through a nitrogen atom (e.g., benzenesulfonamido, N-ethyltoluenesulfonamido, heptafluorobutaneamido, 2,3,4,5,6-pentafluorobenzamido, octanesulfonamido, p-cyanophenylureido, N-N-diethylsulfamoyl, 1-piperidyl, 5,5-dimethyl-2,4-dioxo-3-oxazolidinyl, 1-benzylethoxy-3-hydantoinyl, 2N-1,1-dioxo-3(2H)-oxo-1,2-benzoisothiazolyl, 2-oxo-1,2-dihydro-1-pyridinyl, imidazolyl, pyrazolyl, 3,5-diethyl-1,2,4-triazol-1-yl, 5- or 6-bromobenzotriazole-1-yl, 5-methyl-1,2,3,4-triazole-1-yl, benzimidazolyl, 3-benzyl-1-hydantoinyl, 1-benzyl-5-hexadecyloxy-3-dydantoinyl, 5-methyl-1-tetrazolyl, 4-methoxyphenylazo, 4-pivaloylaminophenylazo, and 2-hydroxy-4-propanoylphenylazo), or a group that links through a sulfur atom (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, benzylthio, 2-cyanoethylthio, 1-ethoxycarbonyltridecylthio, 5-phenyl-2,3,4,5-tetrazolylthio, 2-benzothiazolylthio, and 2-dodecylthio-5-thiophenylthio, 2-phenyl-3-dodecyl-1,2,4-triazolyl-5-thio). When $R_2$, $R_3$, $R_4$, or X represents a divalent group to form a dimer, more particularly the divalent group includes a substituted or unsubstituted alkylene group (e.g., methylene, ethylene, 1,10-decylene, and —$CH_2CH_2$—O—$CH_2CH_2$—), a substituted or unsubstituted phenylene group (e.g., 1,4-phenylene, 1,3-phenylene,

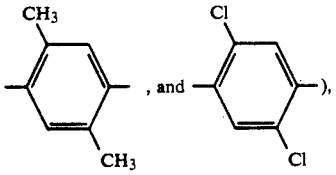

or a group —NHCO—$R_2$—CONH, wherein $R_2$ represents a substituted or unsubstituted alkylene group or phenylene group).

In a case wherein one represented by one of formulae (II) to (IV) is present in a vinyl monomer, the linking group represented by $R_2$, $R_3$, or $R_4$ includes those that can be formed combining alkylene groups (which may be substituted, e.g., methylene, ethylene, 1,10-decylene, and —$CH_2CH_2OCH_2CH_2$—), phenylene groups (which may be substituted, e.g., 1,4-phenylene, 1,3-phenylene,

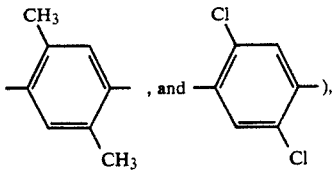

—NHCO—, —CONH—, —O—, —OCO—, and aralkylene groups (e.g.,

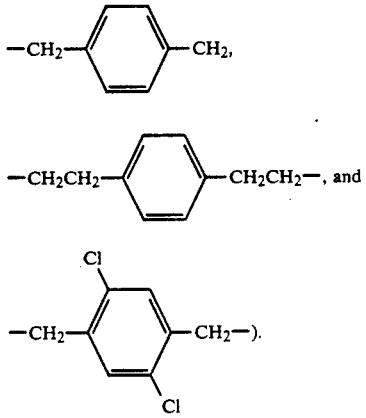

The vinyl group in the vinyl monomer may include those obtained by substituting ones represented by formulae (II) to (VII). Preferable substituents are a hydrogen atom, a chlorine atom, and a lower alkyl having 1 to 4 carbon atoms.

As the non-color-forming ethylene monomer that will not couple with the oxidation product of an aromatic primary amine-developing agent, can be mentioned, for example, acrylic acid, α-chloroacrylic acid, α-alacrylic acid (e.g., methacrylic acid), and esters and amides derived from these acrylic acids (e.g., acrylamide, n-butyl acrylamide, t-butyl acrylamide, diacetone acrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxymethacrylate), methylene bisacrylamide, vinyl esters (e.g., vinyl acetate, vinyl propionate, and vinyl laurate), acrylonitrile, methacrylonitrile, aromatic vinyl compounds (e.g., styrene and its derivatives, vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid, maleic anhydride, maleates, N-vinyl-2-pyrrolidone, and 2- and 4-vinylpyridines, which may be used in combination.

Compound examples of the couplers represented by formulae (II) to (VII), methods of synthesizing said couplers, etc. are described in documents, etc. shown below.

Compounds represented by formula (II) are described, for example, in JP-A No. 162548/1984; compounds represented by formula (III) are described, for example, in JP-A No. 43659/1985; the compounds represented by formula (IV) are described, for example, in JP-B ("JP-B" means examined Japanese patent publication) No. 27411/1972; compounds represented by formula (V) are described, for example, in JP-A Nos. 171956/1984 and 172982/1985; compounds represented by formula (VI) are described, for example, in JP-A No. 33552/1985; and compounds represented by formula (VII) are described, for example, in U.S. Pat. No. 3,061,432.

Highly color-forming ballasting groups described, for example, in JP-A Nos. 42045/1983, 214854/1984, 177553/1984, 177554/1984, and 177557/1984 can be applied to any of the compounds represented by formulae (II) to (VII).

Specific examples of pyrazoloazole couplers used in the present invention are given below, but the present invention is not limited to them.

(M-1)

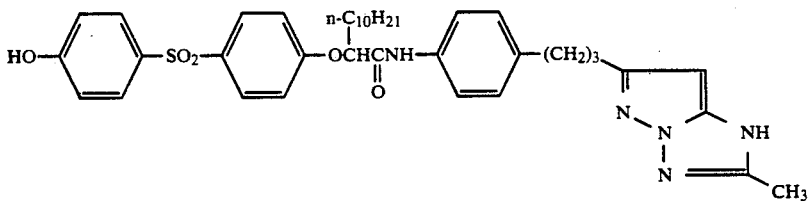

(M-2)

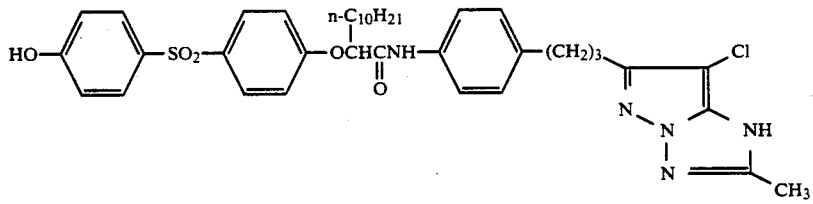

(M-3)

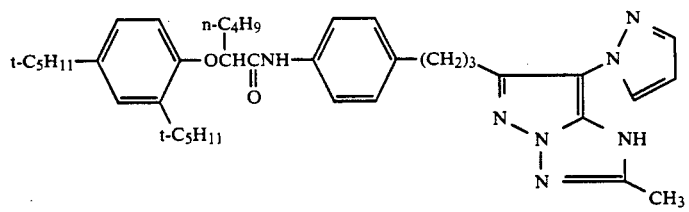

(M-4)

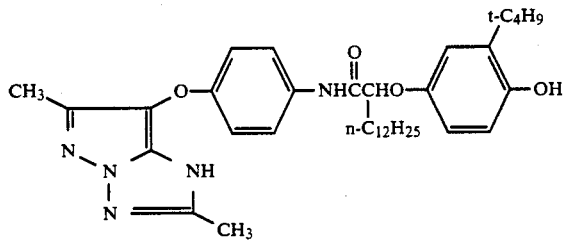

(M-5)

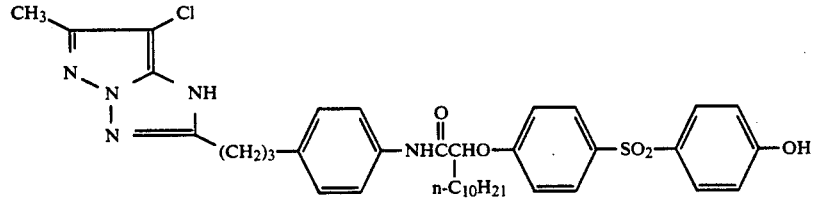

(M-6)

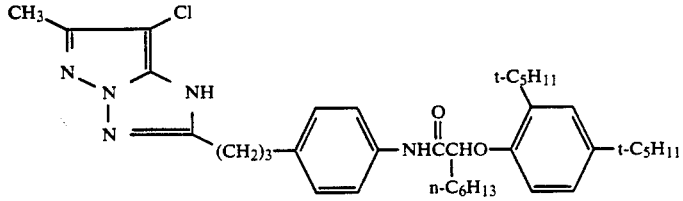

-continued
(M-7)
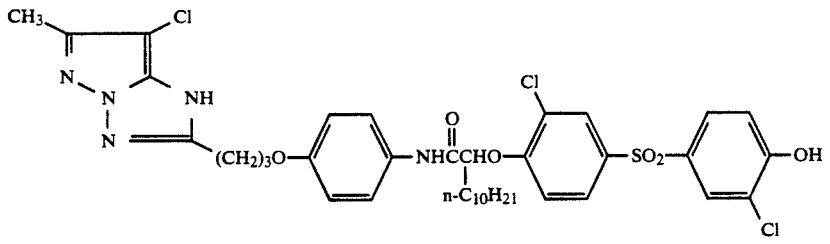
(M-8)
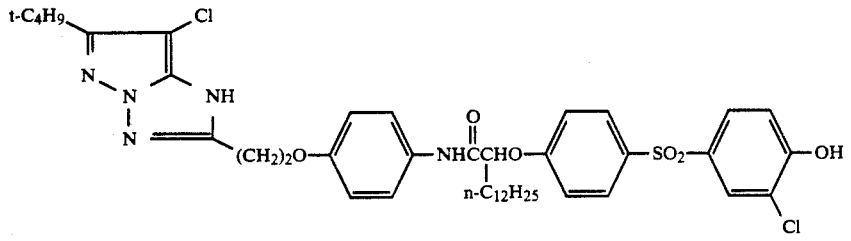
(M-9)
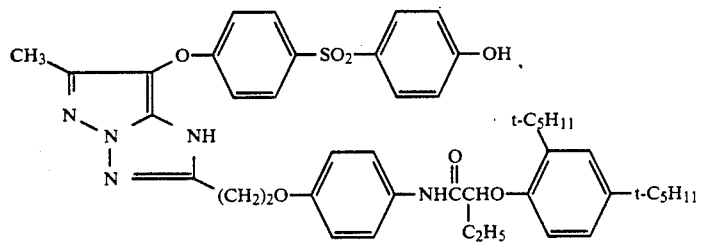
(M-10)
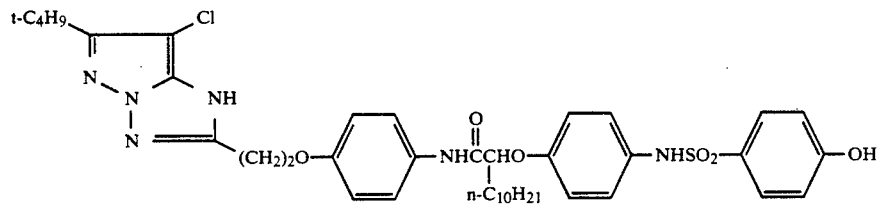
(M-11)
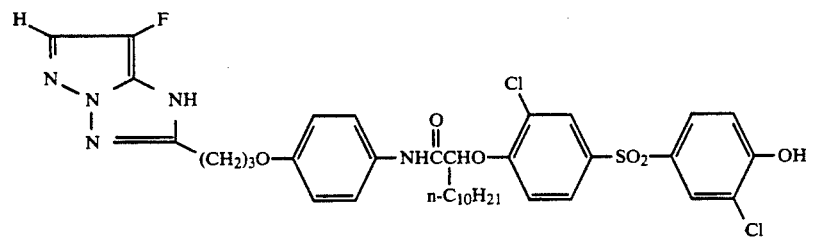
(M-12)
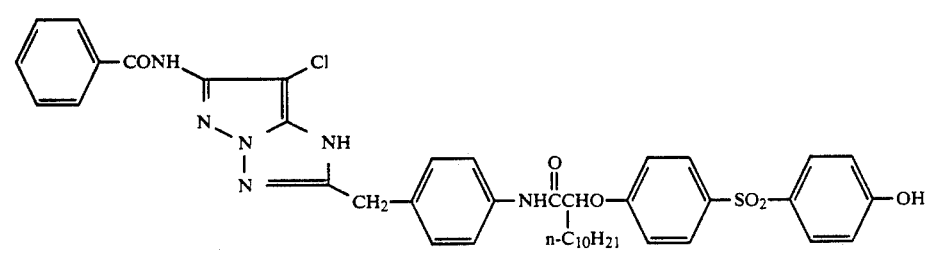

-continued
(M-13)
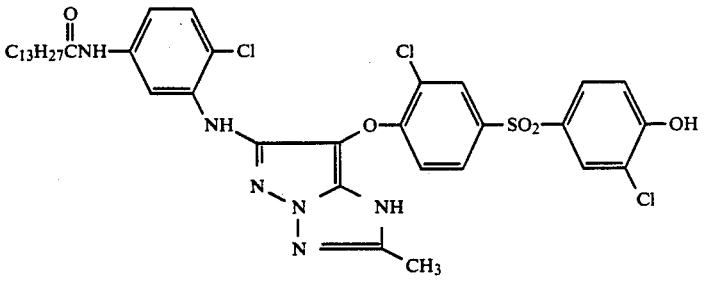
(M-14)
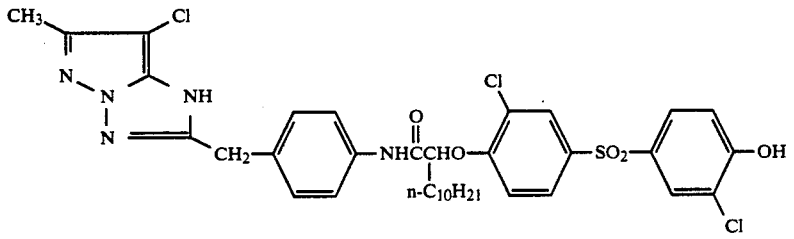
(M-15)
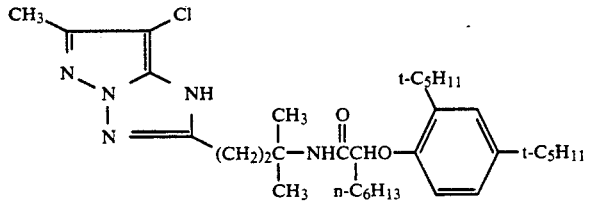
(M-16)
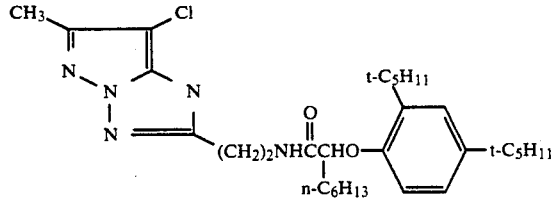
(M-17)
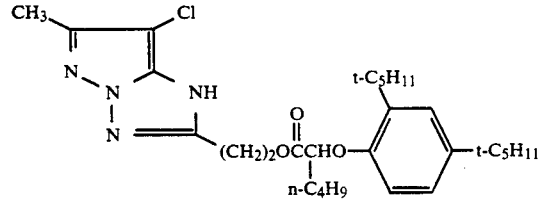
(M-18)
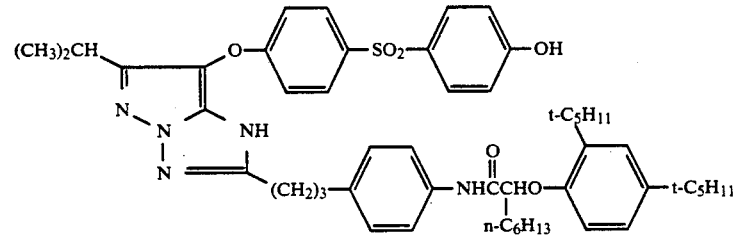
(M-19)
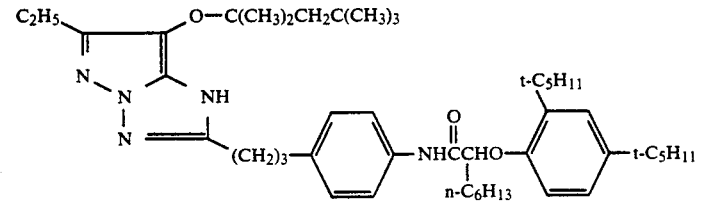

-continued
(M-20)
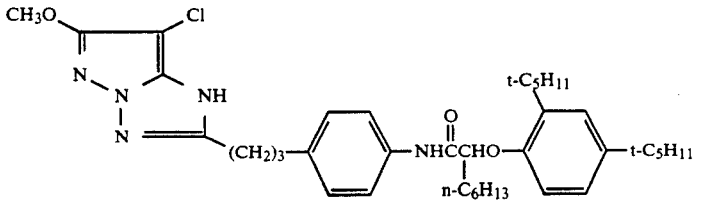
(M-21)
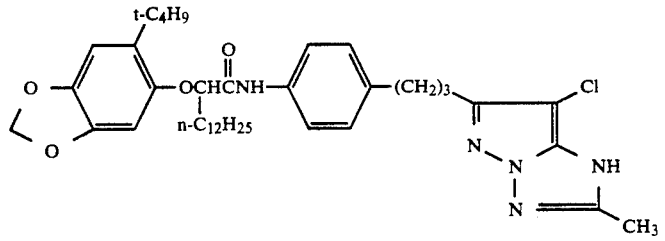
(M-22)
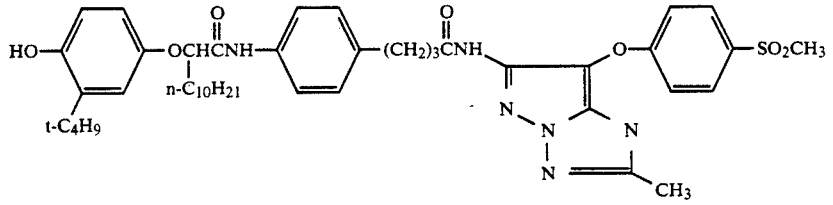
(M-23)
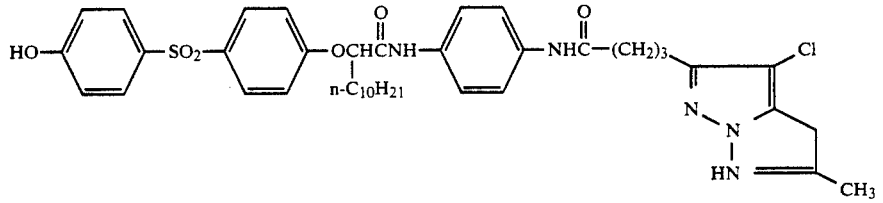
(M-24)
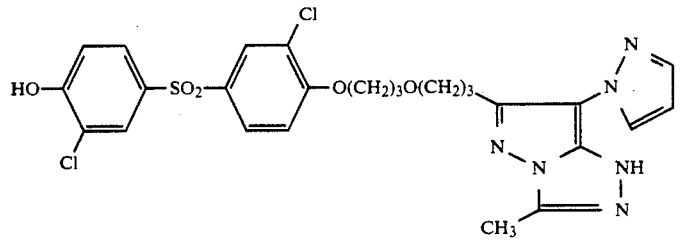
(M-25)
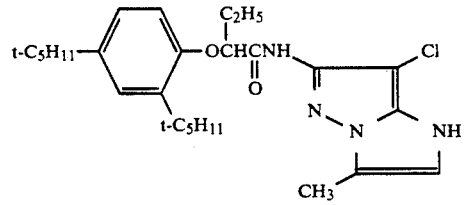
(M-26)
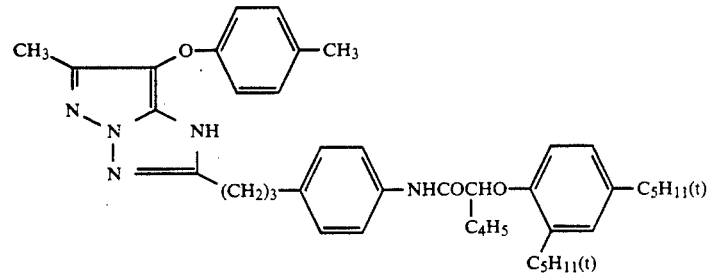

-continued
(M-27)
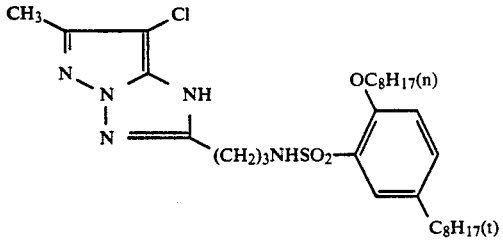
(M-28)
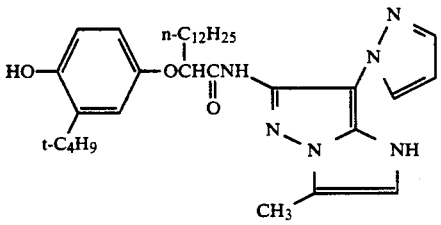
(M-29)
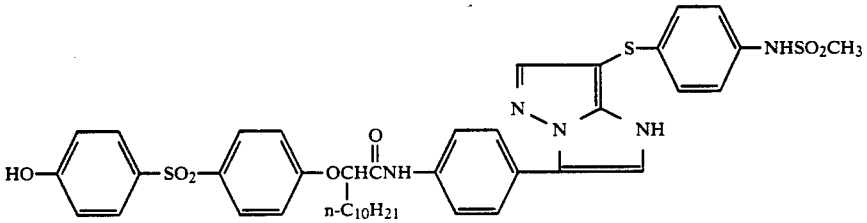
(M-30)
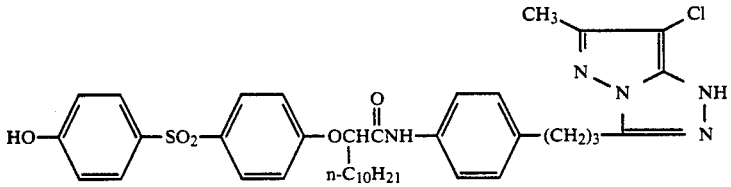
(M-31)
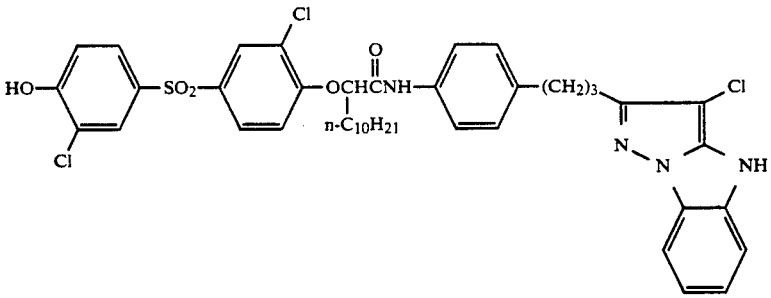
(M-32)
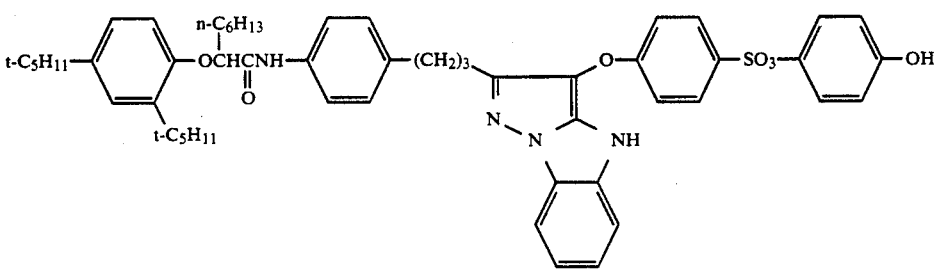

-continued
(M-33)
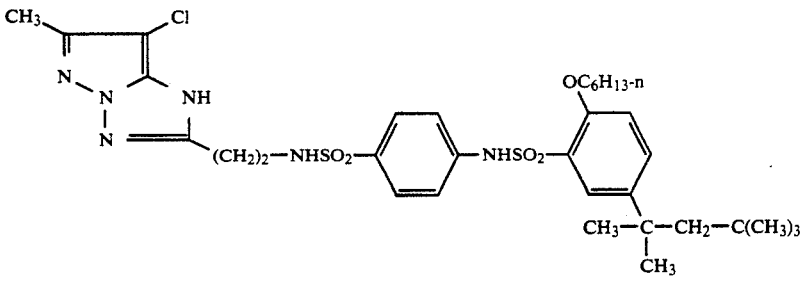
(M-34)
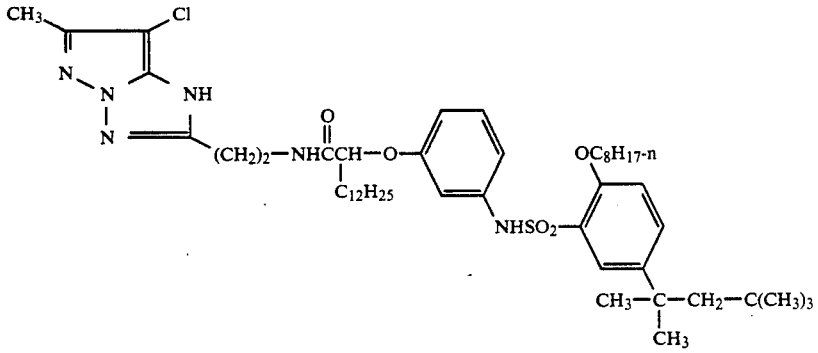
(M-35)
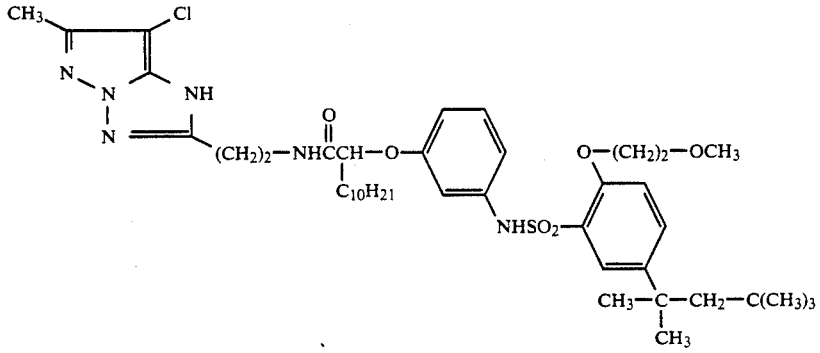
(M-36)
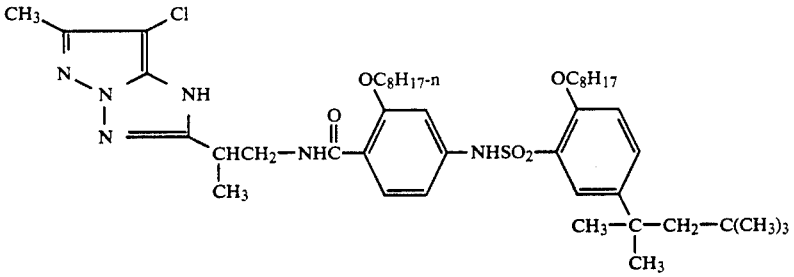
(M-37)
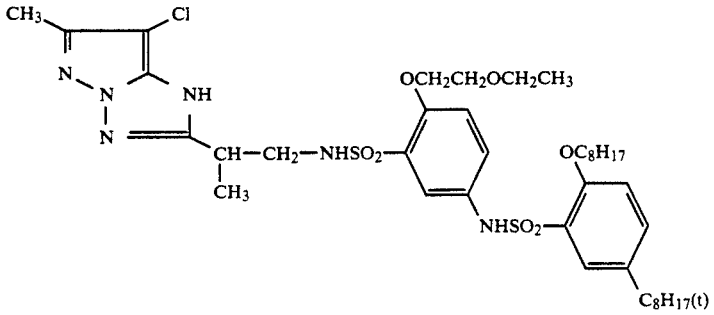

-continued
(M-38)
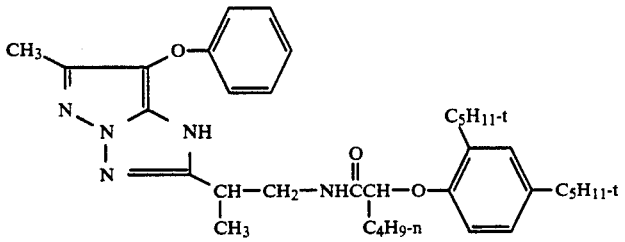
(M-39)
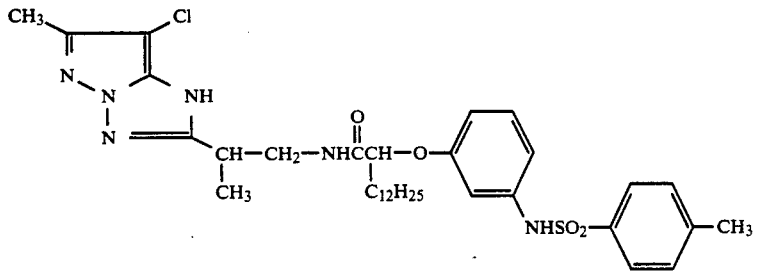
(M-40)
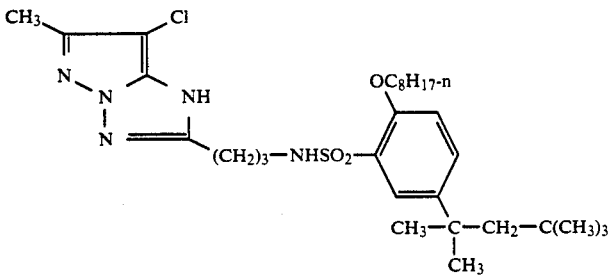
(M-41)
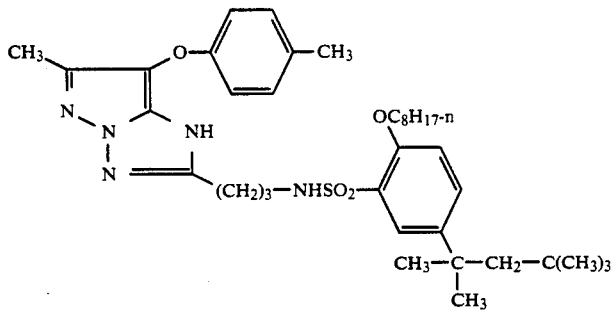
(M-42)
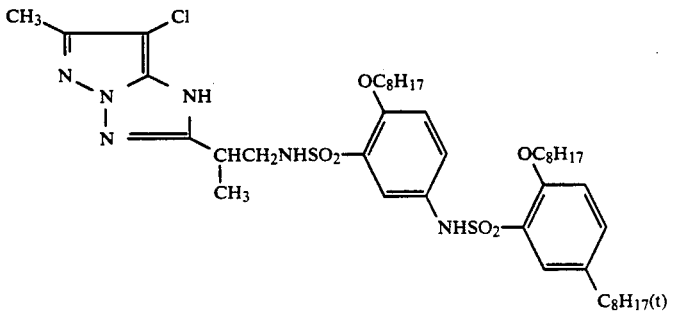

-continued
(M-43)
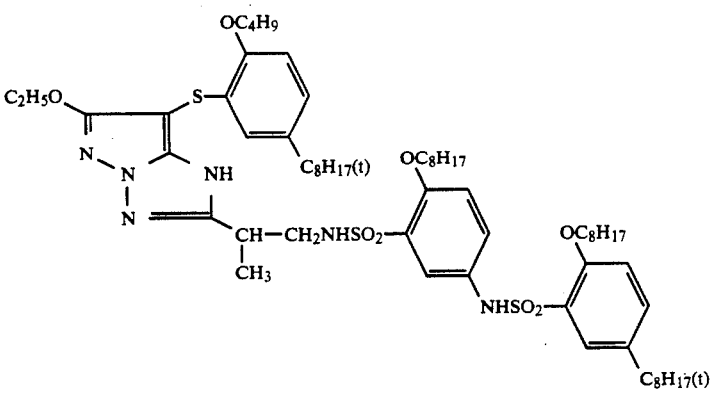
(M-44)
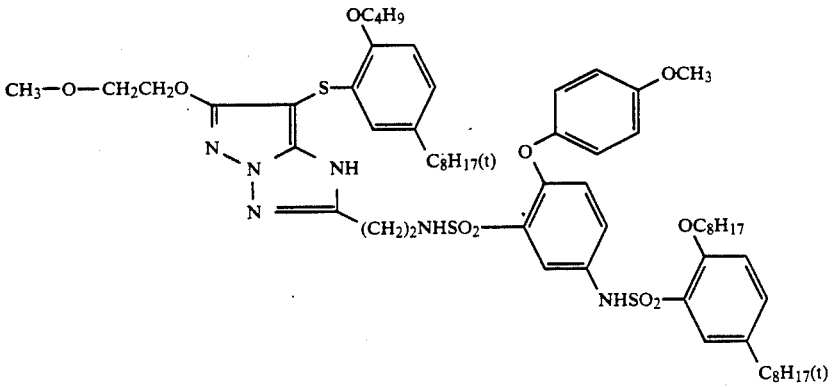
(M-45)
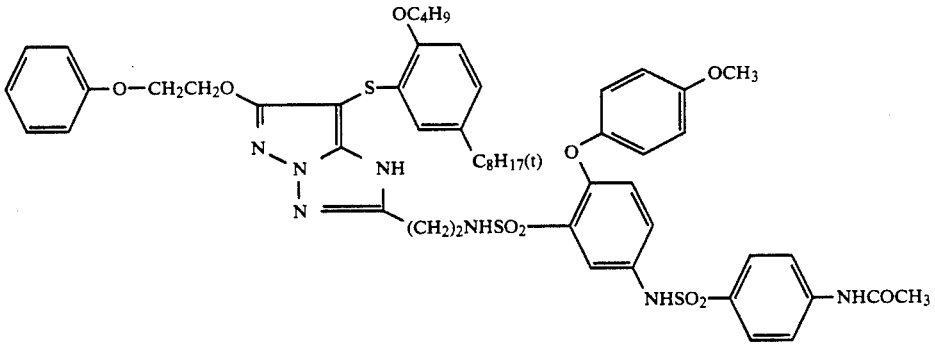
(M-46)
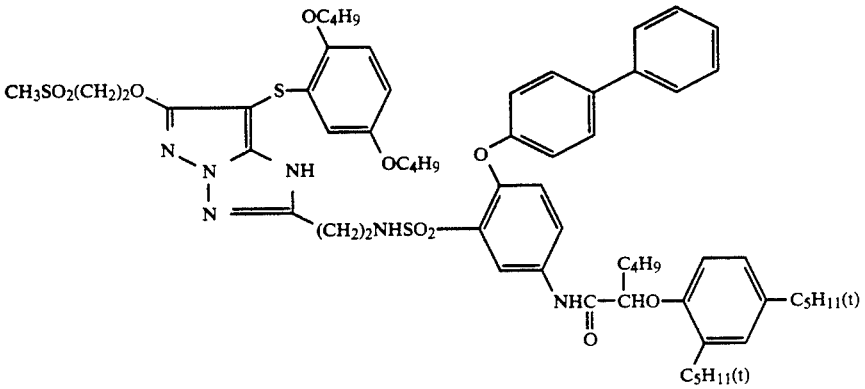

-continued
(M-47)
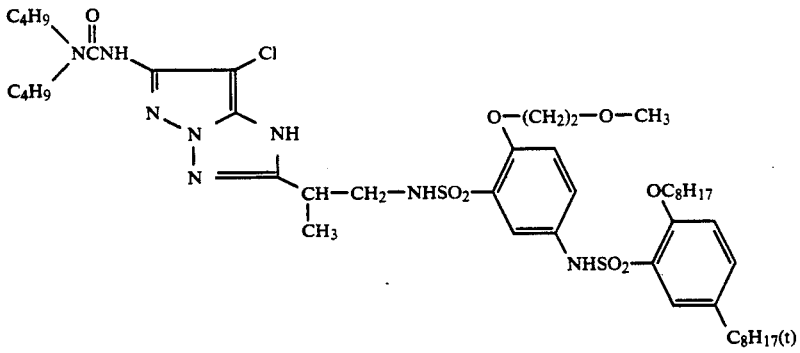
(M-48)
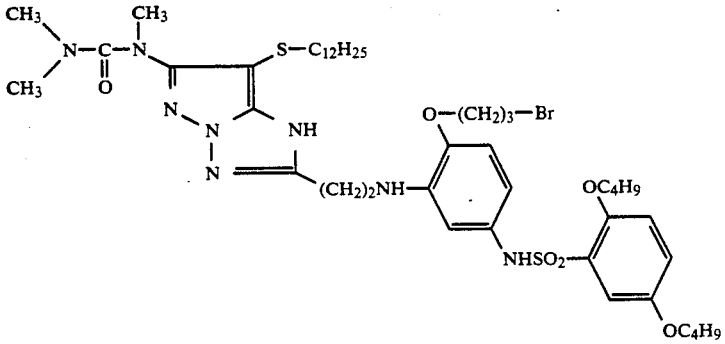
(M-49)
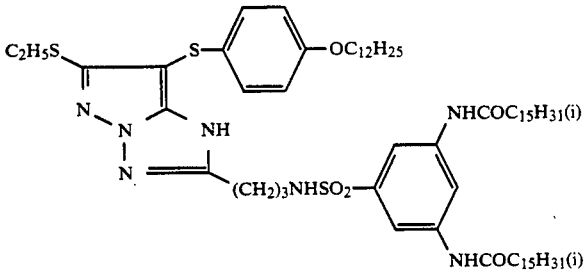
(M-50)
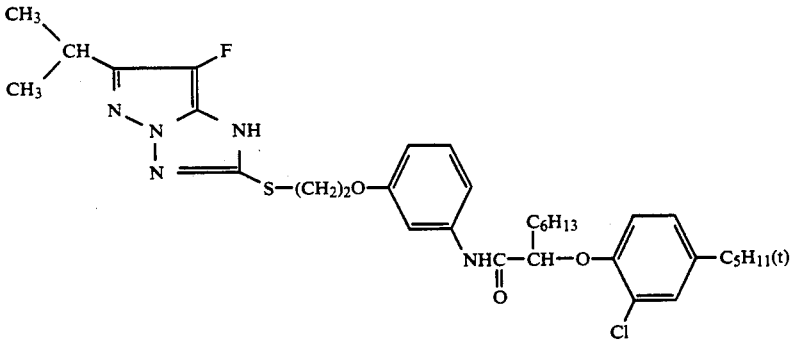
(M-51)
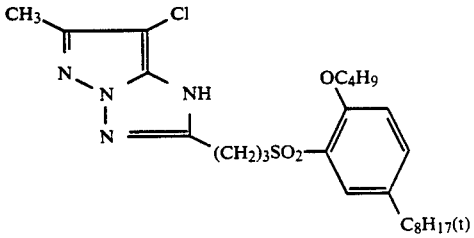

-continued
(M-52)
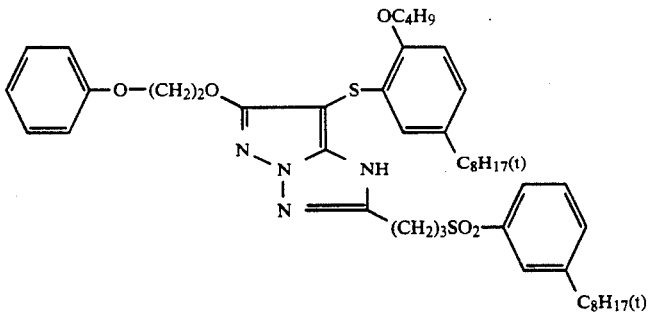
(M-53)
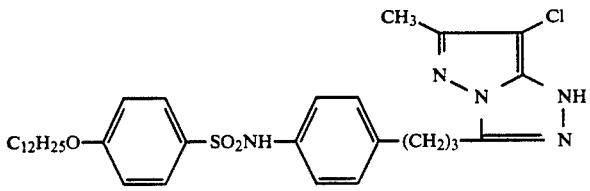
(M-54)
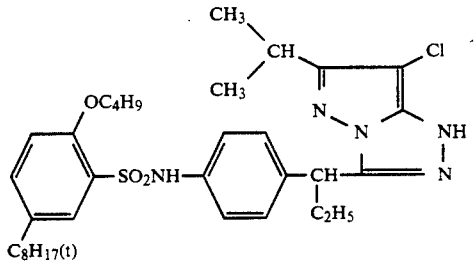
(M-55)
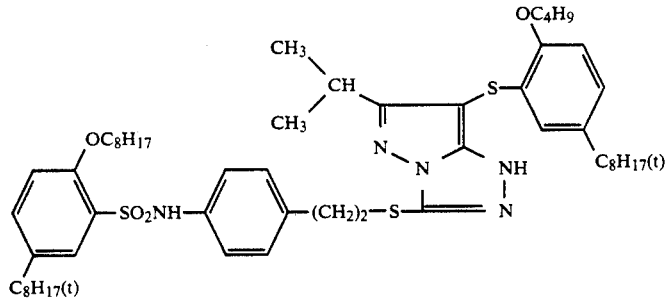
(M-56)
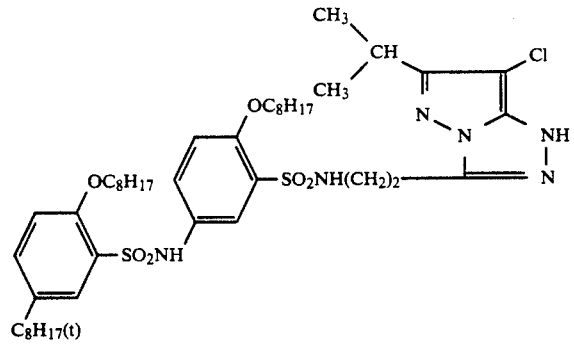
(M-57)
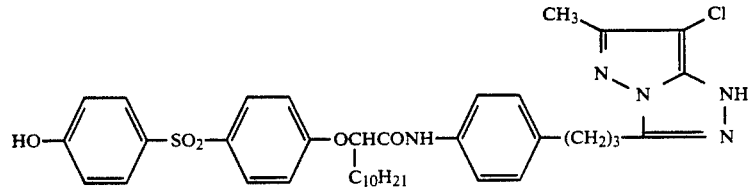

-continued
(M-58)
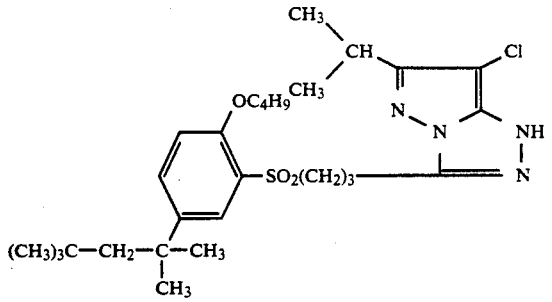
(M-59)
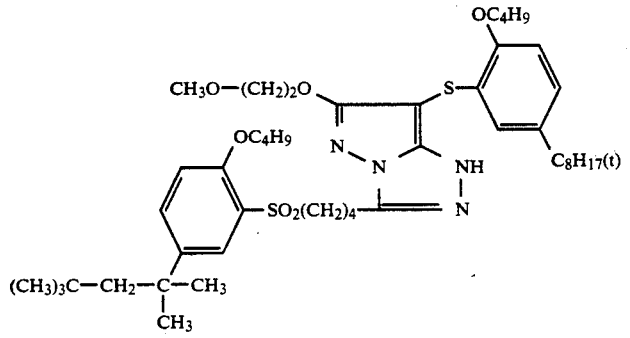
(M-60)
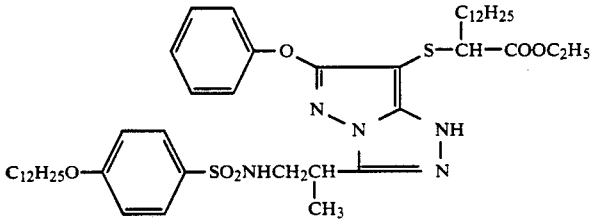
(M-61)
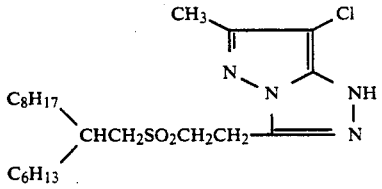
(M-62)
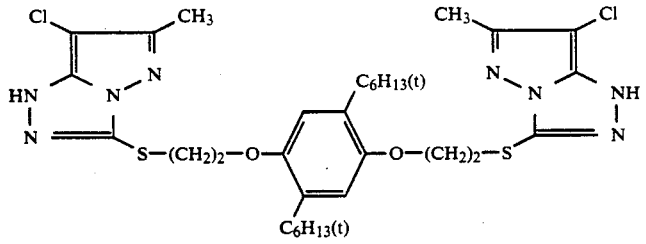
(M-63)
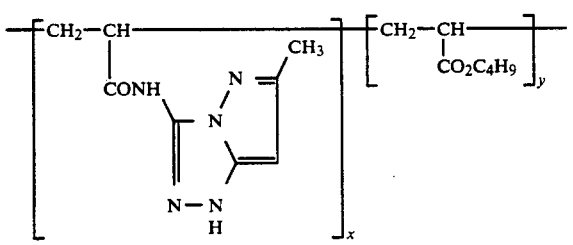
x:y = 50:50
(in weight ratio)

-continued
(M-64)
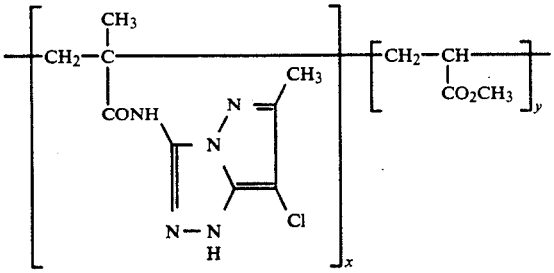
x:y = 40:60 (in weight ratio)
(M-65)
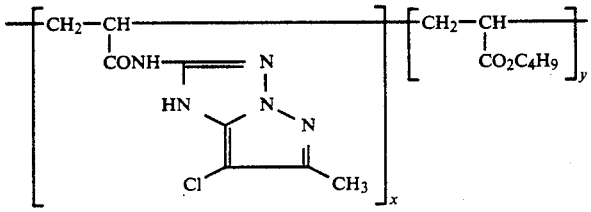
x:y = 50:50
(in weight ratio)
(M-66)
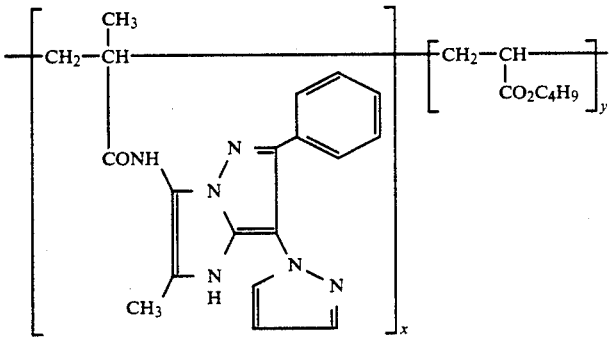
x:y = 55:45
(in weight ratio)
(M-67)
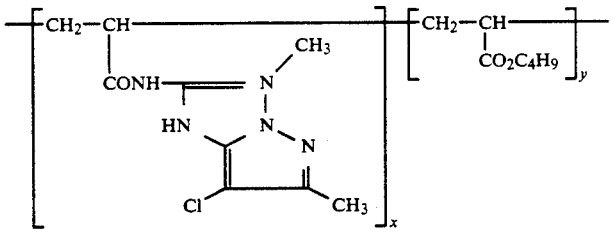
x:y = 50:50
(in weight ratio)
(M-68)
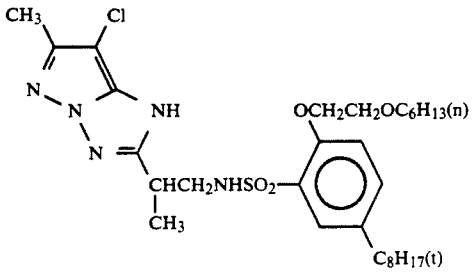

-continued

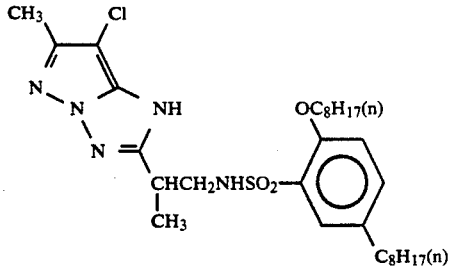

(M-69)

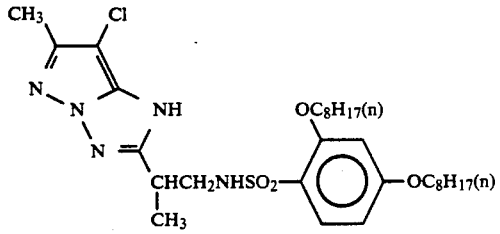

(M-70)

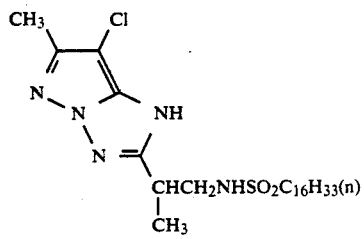

(M-71)

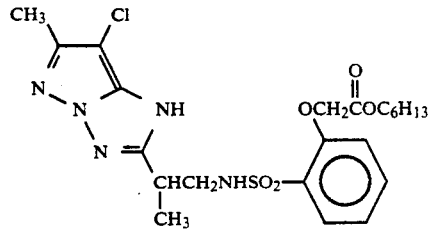

(M-72)

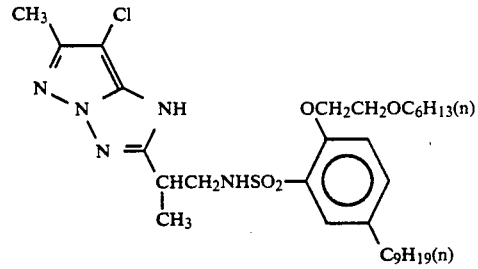

(M-73)

These couplers are added to an emulsion layer in an amount of $2\times10^{-3}$ to $5\times10^{-1}$ mol, preferably $1\times10^{-2}$ to $5\times10^{-1}$ mol, per mol of silver halide in the emulsion layer.

In order to satisfy the characteristics desired for the photographic materials, various couplers can be employed as a combination of two or more couplers in a layer, or the same compound can be employed in two or more layers.

The above-mentioned emulsion layer is preferably a green-sensitive emulsion layer comprising high silver halide emulsion.

The couplers can be incorporated to silver halide emulsions by known processes, for example, as described in U.S. Pat. No. 2,322,027. For example, the couplers are dissolved in an alkyl phthalate (e.g., dibutyl phthalate and dioctyl phthalate), phosphoric acid ester (e.g., diphenyl phosphate, triphenyl phosphate, tricresyl phosphate, and dioctylbutyl phosphate), citric acid ester (e.g., acetyltributyl citrate), benzoic acid ester (e.g., octyl benzoate), acrylamide (e.g., diethyllaurylamide), fatty acid ester (e.g., dibutyloxyethyl succinate and diethyl azelate), trimesic acid ester (e.g., tributyl trimesinate), or an organic solvent having a boiling temperature of 30° to 150° C., for example, lower alkyl acetate, such as ethyl acetate and butyl acetate, ethyl propionate, secondary butyl alcohol, methyl isobutyl ketone, β-ethoxy-ethyl acetate, and methylcellosolve acetate, and then dispersed in hydrophilic colloid. A mixture of the above-mentioned high boiling organic solvent and low boiling organic solvent may be used.

The couplers to be used in the present invention can be incorporated to photographic materials by various known dispersing processes. Examples of a high-boiling organic solvent for use in the oil-in-water dispersing process are described in U.S. Pat. No. 2,322,027. The steps and effect of the latex dispersion method and examples of latex for impregnation are described in U.S. Pat. No. 4,199,363 and German Patent Application (OLS) Nos. 2,541,274 and 2,541,230, and the dispersing process by an organic solvent-soluble polymer is described in, for example, International Application No. PCT/JP/87/00492.

Examples of the organic solvent for use in the above-described oil-in-water dispersing process include, for example, an alkyl phthalate (e.g., dibutyl phthalate and dioctyl phthalate), phosphoric acid ester (e.g., diphenyl phosphate, triphenyl phosphate, tricresyl phosphate, and dioctylbutyl phosphate), citric acid ester (e.g., acetyltributyl citrate), benzoic acid ester (e.g., octyl benzoate), alkylamide (e.g., diethyllaurylamide), fatty acid ester (e.g., dibutyloxyethyl succinate and diethyl azelate), trimesic acid ester (e.g., tributyl trimesinate), or an organic solvent having a boiling temperature of 30° to 150° C., for example, lower alkyl acetate, such as ethyl acetate and butyl acetate, ethyl propionate, secondary butyl alcohol, methyl isobutyl ketone, β-ethoxy-ethyl acetate, and methylcelloselve acetate, and then dispersed in hydrophilic colloid. A mixture of the above-mentioned high boiling organic solvent and low boiling organic solvent may be used.

Now the color-developer for use in the present invention will be described in detail.

The following describes the range of the replenishing amount of the color developer in the present invention, that is, the amount of 20 to 120 ml per $m^2$ of the silver halide photographic material. To lower the replenishing amount of a developer to 120 ml or below per $m^2$ of a silver halide photographic material was impractical in the prior art because of the problems discussed above, and it has therefore become possible for the first time by the present invention. The expression "replenishing amount of 120 ml per $m^2$ of photographic material" is a value at the boundary between the range that has become possible for the first time by the present invention and the range made possible by a combination of prior techniques. If the replenishing amount of the developer is less than 20 ml per $m^2$ of the photographic material, the amount of the processing solution carried over from the developing bath by the photographic material surpasses the replenishing amount, though the situation differs more or less depending on the type of photographic material, and the processing solution decreases to cause the continuous process to become impractical.

In the practice of the present invention, it is more preferable to use a developer substantially free from benzyl alcohol in order to decrease the change of photographic characteristics. Herein the expression "substantially free from benzyl alcohol" means that the concentration of benzyl alcohol is preferably 2 ml/l or below, more preferably 0.5 ml/l or below, and most preferably none at all.

It is more preferable that the developer used in the present invention is substantially free from sulfite ions. Sulfite ions function as a preservative of developing agents, and at the same time they have an action to dissolve silver halides and an action to react with the oxidized product of developing agents, thereby lowering the dye-forming efficiency. Such actions are presumed to be one of the causes of increased changes in the photographic characteristics and the above-mentioned occurrence of suspended matter when the replenishing amount of a color developer is lowered. Herein the expression "substantially free from sulfite ions" means that the concentration of sulfite ions is $5.0\times10^{-3}$ mol/l, and most preferably none at all. However, in the present invention, a quite small amount of sulfite ions used to prevent the processing kit from being oxidized, in which kit a developer is condensed before preparing therefrom an intended solution, is excluded.

In the present invention, which is required to use the color-developing solution not containing sulfite ion substantially, in order to restrain the retarioration of the developing solution, physical means, for example, to not use the developing solution for a long time, and to use a floating cover or to decrease the opened surface-ratio in the developing bath to repress the effect of oxydation by air, and chemical means, for example, to control the temperature of developing solution, and to add an organic preservative, may be employed. Of these means the method of using an organic preservative is advantageous in view of convenience.

The processing method of the present invention have an effect particularly on a continuous processing. Herein, "continuous processing" means a processing that is not a batch-processing, but is carried out continuously being maintained the processability constantly by means, for example, by adding a replenishing solution to get over the fatigue of processing solution accompanied with proceeding the developing process. It is generally to use an automatic developing machine.

It is preferable that the developer used in the present invention is substantially free from sulfite ions, and it is more preferable that further the developer is substantially free from hydroxylamine. This is because hydroxylamine, which functions as a preservative of developers, at the same time has an activity on the development of silver, and it is considered that a change in the concentration of hydroxylamine greatly affects the photographic characteristics. Herein the expression "substantially free from hydroxylamine" means that the concentration of hydroxylamine is preferably $5.0\times10^{-3}$ mol/l or below, and most preferably none at all.

Preferably the developer used in the present invention contains, instead of hydroxylamine and sulfite ions, an organic preservative.

The term "organic preservative" means organic compounds generally that can reduce the rate of deterioration of aromatic primary amine color-developing agents when added to the processing solution for the color photographic material. That is, organic preservatives are organic compounds having a function to prevent color photographic agents from being oxidized with air or the like, and in particular, hydroxylamine derivatives (excluding hydroxylamine), hydroxamic acids, hydrazines, hydrazines, phenols, α-hydroxyketones, α-aminoketones, saccharides, monoamines, diamines, polyamines, quaternary ammonium salts, nitroxy radicals, alcohols, oximes, diamide compounds, and condensed ring-type amines are effective organic preservatives. They are disclosed, for example, in JP-B Nos. 147823/1986, 173595/1986, 165621/1986, 188619/1986, 197760/1986, 186561/1986, 198987/1986, 201861/1986, 186559/1986, 170756/1986, 188742/1986, and 188741/1986, U.S. Pat. Nos. 3,615,503 and 2,494,903, JP-A No. 143020/1987, and JP-B ("JP-B" means examined Japanese patent publication) No. 30496/1973.

Regarding the preferable organic preservatives mentioned above, their formulas and typical compounds are mentioned below, but the present invention is not limited to them.

It is desirable that the amount of the compounds mentioned below to be added to the color developer is 0.005 to 0.5 mol/l, and preferably 0.03 to 0.1 mol/l.

As hydroxylamine derivatives, the following are preferable:

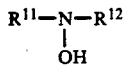

Formula (VIII)

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom. The ring structure of the heterocyclic ring is a 5- to 6-membered ring, it is made up of carbon atoms, halogen atoms, oxygen atoms, nitrogen atoms, sulfur atoms, etc., and it may be saturated or unsaturated.

It is preferable that $R^{11}$ and $R^{12}$ each represent an alkyl group or an alkenyl group having preferably 1 to 10 carbon atoms, more preferably 1 to 5 carbon atoms. As nitrogen-containing heterocyclic rings formed by bonding $R^{11}$ and $R^{12}$ together can be mentioned, for example, a piperidyl group, a pyrolidyl group, an N-alkylpiperazyl group, a morpholyl group, an indolinyl group, and a benztriazole group.

Preferable substituents of $R^{11}$ and $R^{12}$ are a hydroxyl group, an alkoxy group, an alkylsulfonyl group, an arylsulfonyl group, an amido group, a carboxyl group, a cyano group, a sulfo group, a nitro group, and an amino group.

Exemplified compounds:

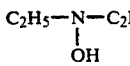

VIII-1

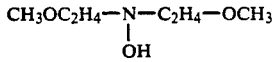

VIII-2

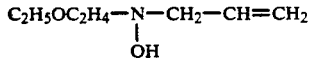

VIII-3

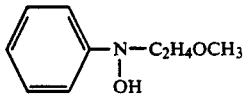

VIII-4

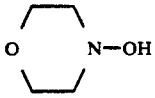

VIII-5

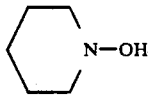

VIII-6

-continued

Exemplified compounds:

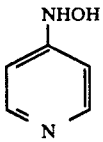

VIII-7

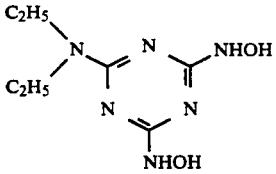

VIII-8

As hydroxamic acids the following compounds are preferable:

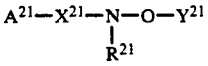

Formula (IX)

wherein $A^{21}$ represents a hydrogen atom, a substituted or unsubstituted alkyl group, a substituted or unsubstituted aryl group, a substituted or unsubstituted amino group, a substituted or unsubstituted heterocyclic group, a substituted or unsubstituted alkoxy group, a substituted or unsubstituted aryloxy group, a substituted or unsubstituted carbamoyl group, a substituted or unsubstituted sulfamoyl group, an acyl group, a carboxy group, a hydroxyamino group, or a hydroxyaminocarbonyl group. As a substituent can be mentioned a halogen atom, an aryl group, an alkyl group, and an alkoxy group.

It is preferable that $A^{21}$ represents a substituted or unsubstituted alkyl group, a substituted or unsubstituted aryl group, a substituted or unsubstituted amino group, a substituted or unsubstituted alkoxy group, or a substituted or unsubstituted aryloxy group. Particularly preferable examples include a substituted or unsubstituted amino group, a substituted or unsubstituted alkoxy group, and a substituted or unsubstituted aryloxy group. The number of carbon atoms is preferably 1 to 10.

$X^{21}$ represents

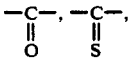

$-SO_2-$, or $-SO-$. Preferably $X^{21}$ is

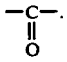

$R^{21}$ represents a hydrogen atom, a substituted or unsubstituted alkyl group, or a substituted or unsubstituted aryl group. $A^{21}$ and $R^{21}$ may together form a ring structure. The substituents are the same as mentioned in $A^{21}$. $R^{21}$ is preferably a hydrogen atom.

$Y^{21}$ represents a hydrogen atom or a group that can become a hydrogen atom by a hydrolysis reaction.

Exemplified compound:

IX-1

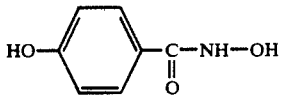

IX-2

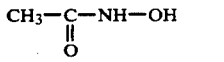

IX-3

IX-4

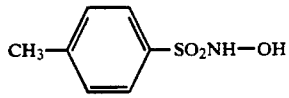

IX-5

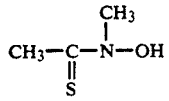

IX-6

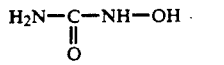

As hydrazines and hydrazides the following compounds are preferable:

Formula (X)

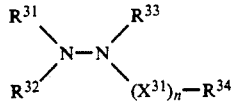

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $R^{34}$ represents a hydroxy group, a hydroxyamino group, a substituted or unsubstituted alkyl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group. The heterocyclic group is a 5- or 6-membered ring made up of C, H, O, N, S, and/or a halogen atom, and it may be substituted or unsubstituted. $X^{31}$ represents a divalent group selected from —CO—, —$SO_2$—, and

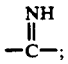

n is 0 or 1, provided that when n=0, $R^{34}$ represents a group selected from an alkyl group, an aryl group, or a heterocyclic group. $R^{33}$ and $R^{34}$ may together form a heterocyclic ring.

In formula (X), $R^{31}$, $R^{32}$, and $R^{33}$ each are preferably a hydrogen atom or an alkyl group having 1 to 10 carbon atoms, particularly $R^{31}$ and $R^{32}$ each are most preferably a hydrogen atom.

In formula (X), $R^{34}$ is preferably an alkyl group having 1 to 20 carbon atoms, an aryl group having 6 to 20 carbon atoms, an alkoxy group having 1 to 20 carbon atoms, a carbamoyl group having 1 to 20 carbon atoms, or an amino group having 0 to 20 carbon atoms, in particular preferably an alkyl group or a substituted alkyl group. The preferable substituents of an alkyl group include a carboxyl group, a sulfo group, a nitro group, an amino group, and a phosphono group. $X^{31}$ is preferably —CO— or —$SO_2$—, most preferably —CO—.

Exemplified compounds:

X-1

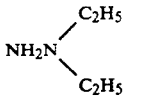

X-2

$NH_2NH(CH_2)_4SO_3H$

X-3

$NH_2NH(CH_2)_2OH$

X-4

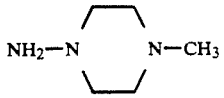

X-5

X-6

$NH_2NHCOCH_3$

X-7

$NH_2NHCOOC_2H_5$

X-8

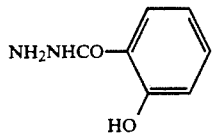

X-9

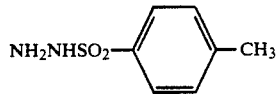

X-10

$NH_2NHCONH_2$

X-11

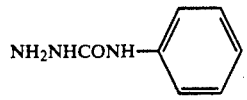

X-12

$NH_2NHSO_3H$

X-13

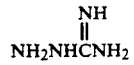

X-14

$NH_2NHCOCONHNH_2$

X-15

$NH_2NHCH_2CH_2CH_2SO_3H$

X-16

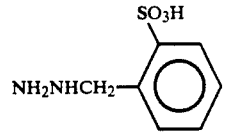

X-17

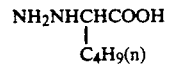

X-18

$NH_2NHCH_2CH_2COOH$

X-19

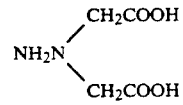

-continued

Exemplified compounds:

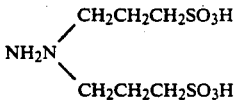

X-20

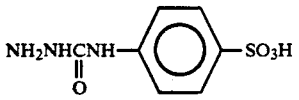

X-21

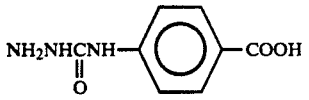

X-22

As phenols the following compounds are preferable:

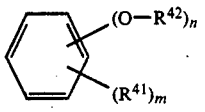

Formula (XI)

wherein $R^{41}$ represents a hydrogen atom, a halogen atom, an alkyl group, an aryl group, an alkoxy group, an aryloxy group, a carboxy group, a sulfo group, a carbamoyl group, a sulfamoyl group, an amido group, a sulfonamido group, an ureido group, an alylthio group, an arylthio group, a nitro group, a cyano group, an amino group, a formyl group, an acyl group, a sulfonyl group, an alkoxycarbonyl group, an aryloxycarbonyl group, an alkoxysulfonyl group, or a aryloxsulfonyl group. When $R^{41}$ is further substituted, as the substituent can be mentioned a halogen atom, an alkyl group, an aryl group, a hydroxyl group, and an alkoxy group. When $R^{41}$ is present 2 or more in number, they may be the same or different, and if they are adjacent, they may together form a ring. The ring structure may be a 5- or 6-membered ring, which is made up of C, H, a halogen atom, O, N, etc. They may be saturated or unsaturated. $R^{42}$ represents a hydrogen atom or a hydrolyzable group, and m and n each are integers of 1 to 5.

In formula (XI), preferably $R^{41}$ represents an alkyl group, a halogen atom, an alkoxy group, an alkylthio group, a carboxyl group, a sulfo group, a carbamoyl group, an amino group, an amido group, a sulfonamido group, a nitro group, or a cyano group. It is particularly preferably that $R^{41}$ represent an alkoxy group, an alkylthio group, an amino group, or a nitro group, which is preferably in the position ortho or para to the $(OR^{42})$ group. Preferably the number of carbon atoms of $R^{41}$ is 1 to 10, most preferably 1 to 6.

Preferably $R^{42}$ is a hydrogen atom or a hydolyzable group having 1 to 5 carbon atoms. If the $(OR^{42})$ group is present 2 or more in number, it is preferable that they are positioned ortho or para to each other.

Exemplified compounds:

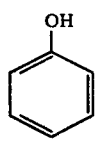

XI-1

-continued

Exemplified compounds:

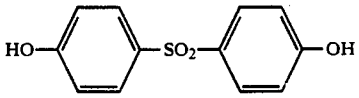

XI-2

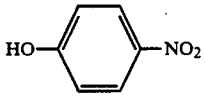

XI-3

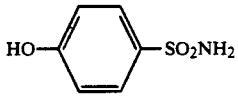

XI-4

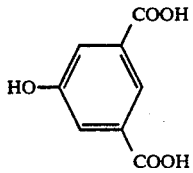

XI-5

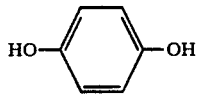

XI-6

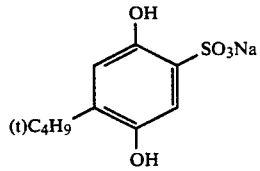

XI-7

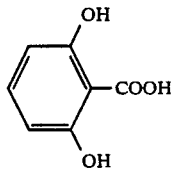

XI-8

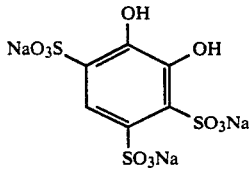

XI-9

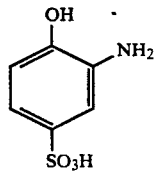

XI-10

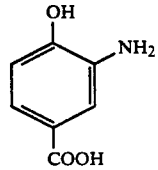

XI-11

As α-hydroxyketones and α-aminoketones the following compounds are preferable:

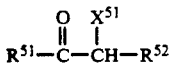

Formula (XII)

wherein $R^{51}$ represents a hydrogen atom, a substituted or unsubstituted alkyl group, a substituted or unsubstituted aryl group, a substituted or unsubstituted alkoxy group, a substituted or unsubstituted aryloxy group, or a substituted or unsubstituted amino group; $R^{52}$ represents a hydrogen atom, a substituted or unsubstituted alkyl group, or a substituted or unsubstituted aryl group; $R^{51}$ and $R^{52}$ may together form a carbocyclic ring or a heterocyclic ring; and $X^{51}$ represents a hydroxyl group or a substituted or unsubstituted amino group.

In formula (XII), preferably $R^{51}$ represents a hydrogen atom, an alkyl group, an aryl group, or an alkoxy group, and $R^{52}$ represents a hydrogen atom or an alkyl group.

Exemplified compounds:

XII-1 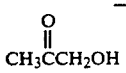

XII-2 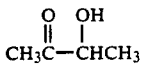

XII-3 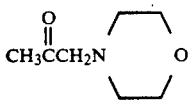

XII-4 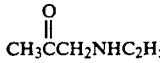

XII-5 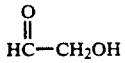

XII-6 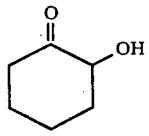

XII-7 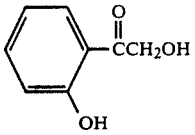

XII-8 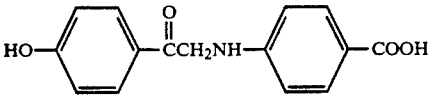

XII-9 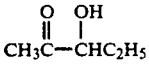

XII-10 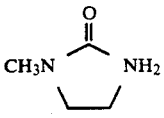

Saccharides are also preferable organic preservatives.

Saccharides (also called carbohydrate) comprise monosaccharides and polysaccharides, and many have the general formula $C_nH_{2m}O_m$. "Monosaccharides" is a term for aldehydes and ketones of polyhydric alcohols (called, respectively, aldoses and ketoses), and their derivatives, such as reduced derivatives, oxidized derivatives, and dehydrated derivatives, as well as aminosaccharides and thiosaccharides. Polysaccharides refer to products obtained by condensing two or more such monosaccharides accompanied by dehydration.

Of these saccharides, preferable are aldoses having a reducing aldehyde group and their derivatives, and more preferably those belonging to monosaccharides.

| Exemplified compounds: | |
|---|---|
| XIII-1 | D-Xylose |
| XIII-2 | L-Arabinose |
| XIII-3 | D-Ribose |
| XIII-4 | D-Deoxyribose |
| XIII-5 | D-Glucose |
| XIII-6 | D-Galactoce |
| XIII-7 | D-Mannose |
| XIII-8 | Glucosamine |
| XIII-9 | L-Sorbose |
| XIII-10 | D-Sorbit (Sorbitol) |

As monoamines can be mentioned:

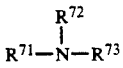

Formula (XIV)

wherein $R^{71}$, $R^{72}$, and $R^{73}$ each represent a hydrogen atom, an alkyl group, an alkenyl group, an aryl group, an aralkyl group or a heterocyclic group, and $R^{71}$ and $R^{72}$, $R^{71}$ and $R^{73}$, or $R^{72}$ and $R^{73}$ may bond together to form a nitrogen-containing heterocyclic group.

$R^{71}$, $R^{72}$, and $R^{73}$ may have a substituent. Particularly preferably $R^{71}$, $R^{72}$, and $R^{73}$ each represent a hydrogen atom or an alkyl group. As a substituent can be mentioned, for example, a hydroxyl group, a sulfo group, a carboxyl group, a halogen atom, a nitro group, and an amino group.

Exemplified compounds:

XIV-1 $N(CH_2CH_2OH)_3$

XIV-2 $H_2NCH_2CH_2OH$

XIV-3 $HN(CH_2CH_2OH)_2$

XIV-4 $C_7H_{15}N(CH_2CH(OH)CH_2OH)_2$

XIV-5 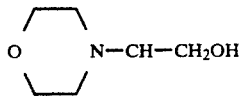

XIV-6 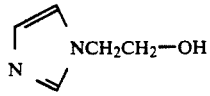

XIV-7 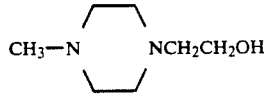

-continued

Exemplified compounds:

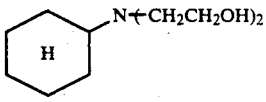

XIV-8

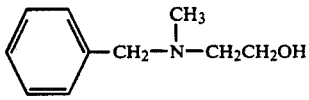

XIV-9

$(HOCH_2CH_2)_2NCH_2CH_2SO_2CH_3$ XIV-10

$HN(CH_2COOH)_2$ XIV-11

$HOOCCH_2CH_2CH(NH_2)COOH$ XIV-12

$H_2NCH_2CH_2SO_2NH_2$ XIV-13

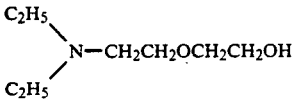

XIV-13

$H_2N—C(CH_2OH)_2$ XIV-14

$HOCH_2CH(NH_2)COOH$ XIV-15

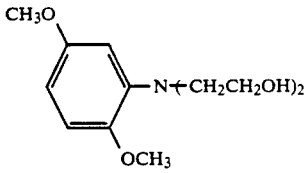

XIV-16

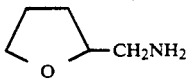

XIV-17

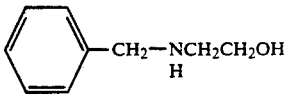

XIV-18

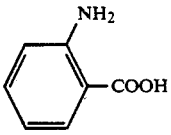

XIV-19

As diamines, the following are preferable:

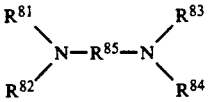

Formula (XV)

wherein $R^{81}$, $R^{82}$, $R^{83}$, and $R^{84}$ each represent a hydrogen atom, an alkyl group, an alkenyl group, an aryl group, an aralkyl group, or a heterocyclic group, and $R^{85}$ represents a divalent organic group, specifically an alkylene group, an arylene group, an aralkylene group, an alkenylene group, or a heterocyclic group.

Particularly preferably $R^{81}$, $R^{82}$, $R^{83}$, and $R^{84}$ each represent a hydrogen atom, or an alkyl group, and $R^{85}$ represents an alkylene group.

Exemplified compounds:

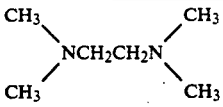

XV-1

$(HOCH_2CH_2)_2NCH_2CH_2N(CH_2CH_2OH)_2$ XV-2

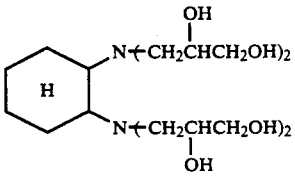

XV-3

$H_2NCH_2CH_2N(CH_2CH_2OH)_2$ XV-4

$H_2NCH_2CH(OH)CH_2NH_2$ XV-5

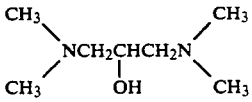

XV-6

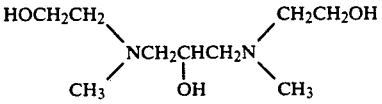

XV-7

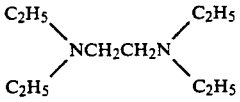

XV-8

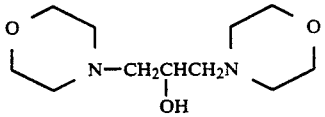

XV-9

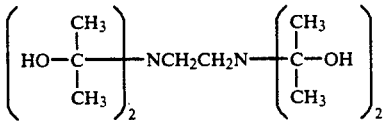

XV-10

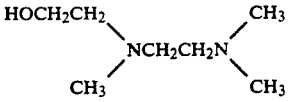

XV-11

As polyamines the following are preferable:

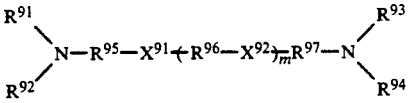

Formula (XVI)

wherein $R^{91}$, $R^{92}$, $R^{93}$, and $R^{94}$ each represent a hydrogen atom, an alkyl group, an alkenyl group, an aryl group, an aralkyl group, or a heterocyclic group, $R^{95}$, $R^{96}$, and $R^{97}$ each represent a divalent organic group, and specifically have the same meaning as that of $R^{85}$ of formula (XV), $X^{91}$ and $X^{92}$ each represent $-\overset{R^{98}}{\overset{|}{N}}-$, —O—, —S—, —CO—, $SO_2$—, —SO—, or a linking group formed by a combination of these linking groups, $R^{98}$ has the same meaning as that of $R^{91}$, $R^{92}$, $R^{93}$ and $R^{94}$, and m is an integer of 1 or over (there is no particular upper limit to m, and if the compound is soluble in water, the compound may have a high molecular weight, but generally m is in the range of 1 to 3).

Exemplified compounds:

XVI-1 $H_2NCH_2CH_2\overset{CH_3}{\overset{|}{N}}CH_2CH_2NH_2$

XVI-2 $(HOCH_2CH_2)_2NCH_2CH_2OCH_2CH_2N(CH_2CH_2OH)_2$

XVI-3 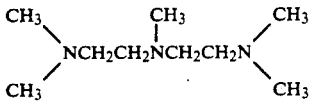

XVI-4 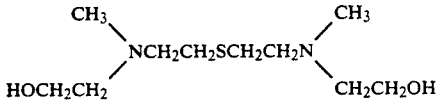

XVI-5 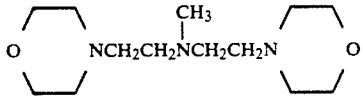

XVI-6 $H_2NCH_2\overset{H}{\overset{|}{C}}HCH_2NCH_2\underset{OH}{\underset{|}{C}}HCH_2NH_2$ XVI-7 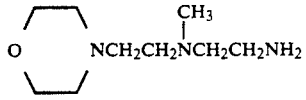

As quaternary ammonium salts, the following are preferable:

Formula (XVII)

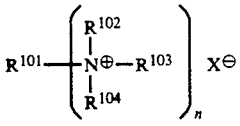

wherein $R^{101}$ represents an n-valent organic group, $R^{102}$, $R^{103}$, and $R^{104}$ each represent a monovalent organic group, which is a group having one or more carbon atoms, and specifically, for example, an alkyl group, an aryl group, or a heterocyclic group, at least two or more of $R^{102}$, $R^{103}$, and $R^{104}$ may bond together to form a heterocyclic ring containing the quaternary ammonium atom, n is an integer of 1 or over, and $X^{\ominus}$ represents a counter anion.

Particularly preferable monovalent groups of the monovalent groups represented by $R^{102}$, $R^{103}$, and $R^{104}$ are substituted or unsubstituted alkyl groups, and most preferably at least one of $R^{102}$, $R^{103}$, and $R^{104}$ is a hydroxyl group, an alkoxyalkyl group, or a carboxylalkyl group. Preferably n is an integer of from 1 to 3, more preferably 1 or 2.

Exemplified compounds:

XVII-1 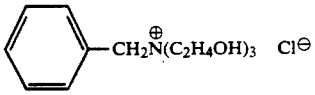

XVII-2 $C_2H_5-\overset{\oplus}{N}(C_2H_4OH)_3\ \tfrac{1}{2}SO_4^{2-}$

XVII-3 $\overset{\oplus}{N}(C_2H_4OH)_4\ Br^-$

XVII-4 $(C_2H_5)_2\overset{\oplus}{N}(C_2H_4OH)_2\ Cl^-$

XVII-5 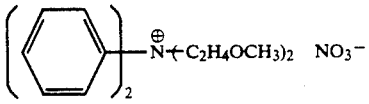

XVII-6 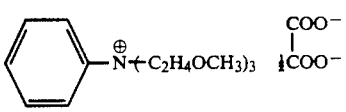

XVII-7 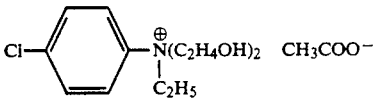

XVII-8 $(HOC_2H_4)_3\overset{\oplus}{N}-C_2H_4-\overset{\oplus}{N}(C_2H_4OH)_3\ SO_4^{2-}$ XVII-9 $(HOC_2H_4)_2\overset{\oplus}{\underset{CH_3}{\underset{|}{N}}}(CH_2)_3\overset{\oplus}{\underset{CH_3}{\underset{|}{N}}}(C_2H_4OH)_2\ 2Cl^-$ XVII-10 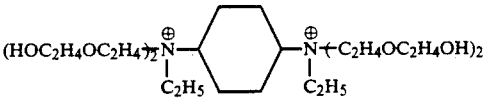

As nitroxy radicals, the following are preferable:

Formula (XVIII)

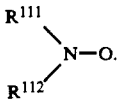

wherein $R^{111}$ and $R^{112}$ each represent a hydrogen atom, an alkyl group, an aryl group, or a heterocyclic group which may have a substituent, such as a hydroxy group, an oxy group, a carbamoyl group, an alkoxy group, a sulfamoyl group, a carboxy group, and a sulfo group. Examples of the heterocyclic group are a pyridyl group, and a piperidyl group, and preferably $R^{111}$ and $R^{112}$ each represent a substituted or unsubstituted aryl group, or a tertiary alkyl group such as a t-butyl group.

Exemplified compounds:

XVIII-1

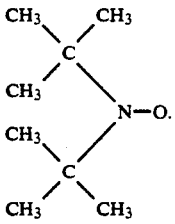

XVIII-2

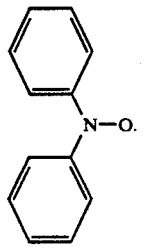

XVIII-3

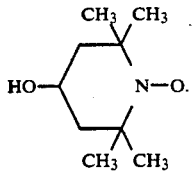

XVIII-4

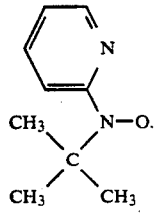

XVIII-5

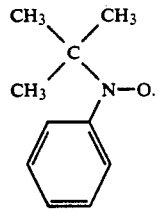

As alcohols, the following are preferable:

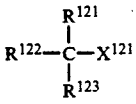

Formula (XIX)

wherein $R^{121}$ represents a hydroxy-substituted alkyl group, $R^{122}$ represents an unsubstituted alkyl group or has the same meaning as that of $R^{121}$, $R^{123}$ represents a hydrogen atom or has the same meaning as that of $R^{122}$, and $X^{121}$ represents a hydroxy group, a carboxyl group, a sulfo group, a nitro group, an unsubstituted or hydroxy-substituted alkyl group, a substituted or unsubstituted amido group, or a sulfonamido group.

In formula (XIX), preferably $X^{121}$ represents a hydroxy group, a carboxyl group, or a hydroxyalkyl group.

Exemplified compounds:

XIX-1

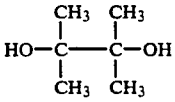

XIX-2

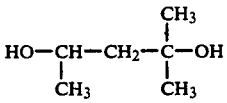

XIX-3

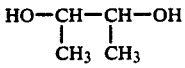

XIX-4 $HO-CH(CH_2OH)_2$

XIX-5 $(HO-CH_2)_3COOH$

XIX-6 $C(CH_2OH)_4$

XIX-7 $(HOCH_2)_3C-CH_3$

XIX-8 $(HOCH_2)_3C-NHCOCH_3$

XIX-9

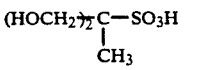

XIX-10

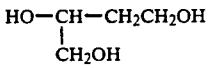

As alcohols, the following are preferable:

Formula (XX)

wherein $R^{131}$, $R^{132}$, and $R^{133}$ each represent a hydrogen atom or an alkyl group, and n is a positive integer up to 500.

Preferably the alkyl group represented by $R^{131}$, $R^{132}$, and $R^{133}$ is one having 5 or less carbon atoms, more preferably 2 or less carbon atoms. It is very preferable that $R^{131}$, $R^{132}$, and $R^{133}$ each represent a hydrogen atom or a methyl group, with a hydrogen atom most preferred.

Preferably, n is a positive integer of 100 or below, more preferably as low as 3 or as high as 30.

Exemplified compounds:

XX-1 $HO(CH_2CH_2O)_4OH$

XX-2 $CH_3O(CH_2CH_2O)_3OH$

XX-3 $CH_3O(CH_2CH_2O)_2OCH_3$

XX-4

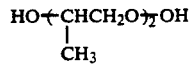

XX-5 $HOCH_2CH_2OCH_3$

XX-6 $C_2H_5O(CH_2CH_2O)_2OH$

XX-7 $HO(CH_2CH_2O)_nH$
av. molecular weight: about 300

-continued

Exemplified compounds:

$HO\text{-}(CH_2CH_2O)_n\text{-}H$ XX-8
av. molecular weight: about 800

$HO\text{-}(CH_2CH_2O)_n\text{-}H$ XX-9
av. molecular weight: about 3000

$HO\text{-}(CH_2CH_2O)_n\text{-}H$ XX-10
av. molecular weight: about 8000

As oximes, the following are preferable:

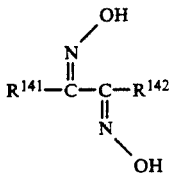

Formula (XXI)

wherein $R^{141}$ and $R^{142}$, which may be the same or different, each represent a hydrogen atom, a substituted or unsubstituted alkyl group, or a substituted or unsubstituted aryl group, and $R^{141}$, and $R^{142}$ may bond together.

In formula (XXI), preferably $R^{141}$ and $R^{142}$ each represent an alkyl group that may be substituted by a halogen atom, a hydroxyl group, an alkoxy group, an amino group, a carboxyl group, a sulfo group, a phosphonic acid group, or a nitro group.

Preferably the sum of the carbon atoms in formula (XIV) is 30 or below, and more preferably 20 or below.

Exemplified compounds:

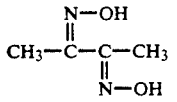

XXI-1

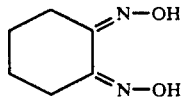

XXI-2

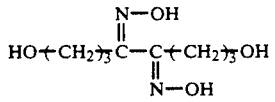

XXI-3

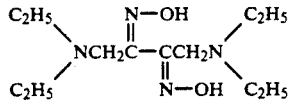

XXI-4

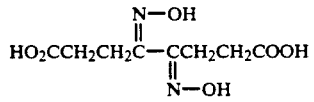

XXI-5

As polyamines, the following are preferable:

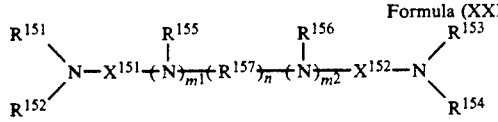

Formula (XXII)

wherein $X^{151}$ and $X^{152}$ each represent —CO— or —$SO_2$, $R^{151}$, $R^{152}$, $R^{153}$, $R^{154}$, and $R^{156}$ each represent a hydrogen atom or a substituted or unsubstituted alkyl group, $R^{157}$ represents a substituted or unsubstituted alkylene group, a substituted or unsubstituted arylene group, or a substituted or unsubstituted aralkylene group, and $m^1$, $m^2$, and n each are 0 or 1.

Exemplified compounds:

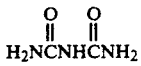

XXII-1

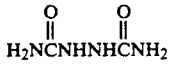

XXII-2

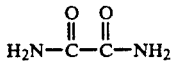

XXII-3

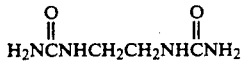

XXII-4

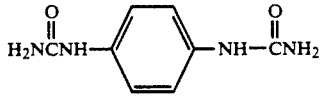

XXII-5

$H_2NSO_2NHSO_2NH_2$ XXII-6

As amines having a condensed ring the following compounds are preferable:

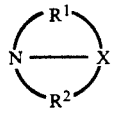

Formula (XXIII)

wherein X represents a trivalent group of atoms necessary to complete a condensed ring, and $R^1$ and $R^2$ each represent an alkylene group, an arylene group, an alkenylene group, or an aralkylene group.

$R^1$ and $R^2$ may be the same or different.

Of the compounds represented by formula (XXIII), particularly preferable compounds are those represented by formulas (1-a) and (1-b):

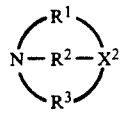

Formula (1-a)

wherein $X^1$ represents

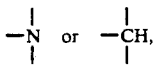

$R^1$ and $R^2$ have the same meaning as defined above for formula (XXIII), and $R^3$ has the same meaning as $R^1$ or $R^2$ or represents

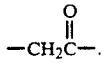

In formula (1-a), preferably $X^1$ represents

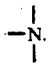

Preferably the number of carbon atoms of $R^1$, $R^2$, and $R^3$ is 6 or below, more preferably 3 or below, and most preferably 2.

Preferably $R^1$, $R^2$, and $R^3$ each represent an alkylene group or an arylene group, most preferably an alkylene group.

Formula (1-b)

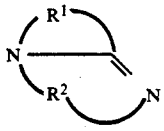

wherein $R^1$ and $R^2$ have the same meaning as defined in formula (XXIII).

In formula (1-b), preferably the number of carbon atoms of $R^1$ and $R^2$ is 6 or below. Preferably $R^1$ and $R^2$ each represent an alkylene group or an arylene group, most preferably an alkylene group.

Of compounds represented by formulae (1-a) and (1-b), those represented by formula (1-a) are preferable.

XXIII-1

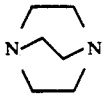

XXIII-2

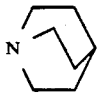

XXIII-3

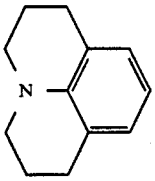

XXIII-4

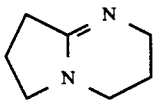

XXIII-5

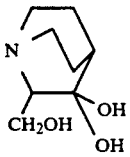

XXIII-6

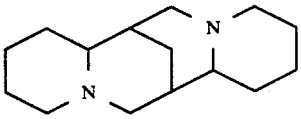

-continued

XXIII-7

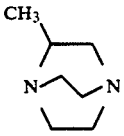

XXIII-8

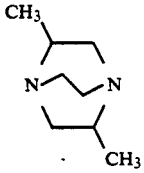

XXIII-9

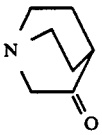

XXIII-10

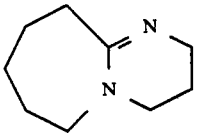

XXIII-11

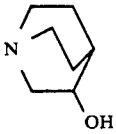

XXIII-12

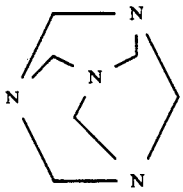

XXIII-13

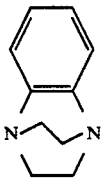

XXIII-14

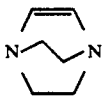

XXIII-15

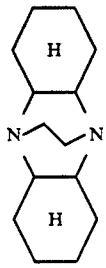

-continued

XXIII-16

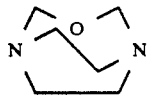

XXIII-17

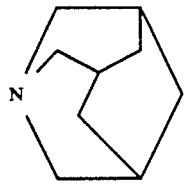

XXIII-18

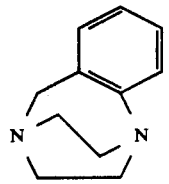

Many of the compounds represented by formulas (VIII) to (XXIII) according to the present invention are readily available commercially.

In the above-described formulas (VIII) to (XXIII), except the case particularly denoted, the number of carbon atoms of the aliphatic substituents (e.g., an alkyl or an alkenyl) or the groups containing them is preferably 1 to 10, more preferably 1 to 6, and the number of carbon atoms of the aromatic substituents (e.g., an aryl) or the group containing them is preferably 1 to 8, more preferably 1 to 5.

Two or more of the above-mentioned preservatives can be used in combination. Preferable combinations include that of at least one compound represented by formulas (VIII) to (XIII) and at least one compound represented by formulas (XIV) to (XXIII).

More preferable combinations to use are that of at least one compound represented by formula (VIII) or (X) and at least one compound represented by formula (XIV) or (XXIII).

The color-developing solution for use in the present invention is described below.

The color-developing solution for use in the present invention may contain a known aromatic primary amine color-developing agent. Preferred examples are p-phenylenediamine derivatives. Representative examples are given below, but they are not meant to limit the present invention:

D-2: N,N-Diethyl-p-phenylenediamine

D-2: 4-[N-Ethyl-N-(β-hydroxyethyl)amino]aniline

D-3: 2-Methyl-4-[N-ethyl-N-(β-hydroxyethyl-)amino]aniline

D-4: 4-Amino-3-methyl-N-ethyl-N-(β-methanesulfonamido ethyl)aniline

In particular, the use of D-4 is preferable.

These p-phenylenediamine derivatives may be in the form of salts, such as sulfates, hydrochloride, sulfites, and p-toluenesulfonates. The amount of said aromatic primary amine developing agent to be used is preferably about 0.1 g to about 20 g, more preferably about 0.5 g to about 10 g, per liter of developer.

Preferably the pH of the color-developer of the present invention is in the range of 9 to 12, more preferably 9 to 11.0, and other known compounds that are components of a conventional developing solution can be contained.

To maintain the above-mentioned pH-value, it is preferable to use various buffer agents. Examples of buffer agents that can be mentioned include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salycylate), potassium o-hydroxybenzoate, sodium 5-sulfo-2-hydroxybenzoate (sodium 5-sulfosalycylate), and potassium 5-sulfo-2-hydroxybenzoate (potassium 5-sulfosalycylate).

Preferably the amount of buffer agent to be added is 0.1 mol/liter or over, more preferably 0.1 to 0.4 mol/liter.

In addition, various chelating agents may also be used in the color-developer, as a suspension agent for calcium and magnesium or for improving the stability of the color-developer.

Specific examples will be given below. The present invention, however, is not limited to them:

Nitrilotriacetic acid
Diethylenetriaminepentaacetic acid
Ethylenediaminetetraacetic acid
Triethylenetetraminehexaacetic acid
N,N,N-trimethylenephosphonic acid
Ethylenediamine-N,N, N',N'-tetramethylenephosphonic acid
1,3-Diamino-2-propanoltetraacetic acid
Transcyclohexanediaminetetraacetic acid
Nitrilotripropionic acid
1,2-Diaminopropanetetraacetic acid
Hydroxyethyliminodiacetic acid
Glycoletherdiaminetetraacetic acid
Hydroxyethylenediaminetriacetic acid
Ethylenediamineorthohydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetate These chelating agents may, if necessary, be used in a combination of two or more compounds.

These chelating agents may each be added in an amount sufficient to sequester metal ions in the color-developer for example, in an amount of about 0.1 g to 10 g per liter of color-developer.

An arbitrary development accelerator may, if needed, be added to the color-developer.

As a development accelerator, each one of thioether compounds disclosed, for example, in JP-B Nos. 16088/1962, 5987/1962, 7826/1963, 12380/1969, and 9019/1970, and U.S. Pat. No. 3,813,247; p-phenylenediamine compounds disclosed in JP-A Nos. 49829/1977 and 15554/1975; quaternary ammonium salts disclosed in JP-A No. 137726/1975, JP-B No. 30074/1969, and JP-A Nos. 156826/1981 and 43429/1977; p-aminophenols described in U.S. Pat. Nos. 2,610,122 and 4,119,462; amine compounds described in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkyleneoxides described in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolydones; hydrazines; mesoionic-type compounds; ionic type compounds; and imidazoles may be added as needed.

It is preferable that the color-developer of the present invention be substantially free of benzyl alcohol. Herein the term "substantially free of benzyl alcohol" means that the amount of benzyl alcohol per liter of color developer is no more than 2 ml, but more preferably benzyl alcohol should not be contained at all.

In the present invention an arbitrary antifoggant may be added if required. Antifoggants that can be added include alkali metal halides, such as sodium chloride, potassium bromide, potassium iodide, and organic antifoggants. Representative examples of organic antifoggants include nitrogen-containing heterocyclic compounds such as benzotriazole, 6-nitrobenzimidazole, 5-nitrobenzotriazole, 5-chloro-benzotriazole, 2-thiazolylbenzimidazole, 2-thiazolyl-methylbenzimidazole, indazoles, hydroxyazindolizine, and adenine.

It is preferable that the color-developer of the present invention contain a fluorescent brightening agent. As a fluorescent brightening agent, 4,4'-diamino-2,2'-disulfostilbene compounds are preferable. The amount of addition is in the range of 0 to 5 g/l, preferably 0.1 to 4 g/l.

Further, surface-active agents, such as alkylsulfonic acids, aliphatic acids, and aromatic carboxylic acids, may be added as needed.

The processing temperature using the color developer of this invention is between 20° to 50° C., preferably 30° to 40° C. The processing time is between 20 sec. to 5 min., preferably 30 sec. to 2 min.

The replenisher amount of color developer of the present invention is in the range of 20 to 120 ml, preferably 30 to 100 ml, per $m^2$ of photographic material. The term "replenisher amount" herein means the amount of the so-called color-developing replenisher to be supplied, excluding the amounts of additives for correcting the deterioration due to lapse of time or condensation.

The above-mentioned additives include, for example, water for diluting the condensated solution, preservatives susceptible to aging, or alkaline agents for raising up the pH-valve.

Color developed photographic emulsion layer are usually bleached. Bleaching may be conducted separately or simultaneously with fixing process (bleach-fixing process). Further, in order to process rapidly, bleach-fixing process may be conducted after bleaching process. Also, processing using two bleach-fixing baths continuously connected, fixing process before bleach-fixing, or bleaching process after bleach-fixing may be effected according to the purpose. As bleaching agents, for example, compounds of polyvalent metals such as iron (III), cobalt (III), chromium (VI), and copper (II) and the like; peracids; quinones; and nitro compounds may be used. Typical examples of useful bleaching agents include ferricyanates; dichromates; organic complex salts of iron (III) or cobalt (III) such as complex salts with an aminopolycarboxylic acid (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiaminetetraacetic acid, or the like) or an organic acid (e.g., citric acid, tartaric acid, maleic acid, or the like); persulfates; bromates; permanganates; nitrosephenols, or the like. Of these, complex salts of iron (III) with aminopolycarboxylic acid including iron (III) ethylenediaminetetraacetate and persulfates are particularly preferable to achieve rapid processing and to prevent environmental pollution. Complex salts of iron (III) with aminopolycarboxylic acid are useful in bleaching solution, particularly in bleach-fixing solution. The pH-value of the bleaching solution or bleach-fixing solution using an iron (III) complex salts with aminopolycarboxylic acid is in the range of 5.5 to 8, although the processing can be conducted in lower range than the above to achieve rapid processing.

In the bleaching solution, the bleach-fixing solution, and their preceding bath solution various bleach-accelerator can be used if necessary. As specific examples of useful bleach-accelerator can be mentioned compounds having a mercapto group or a disulfido group described, for example, in U.S. Pat. No. 3,893,858, West German Patent No. 1,290,812, JP-A No. 95630/1978, and *Research Disclosure* No. 17,129 (July 1978), thiazoline derivatives described in JP-A No. 140129/1975, thiourea derivatives described in U.S. Pat. No. 3,706,561, iodide salts described in JP-A No. 16235/1983, polyoxyethylene compounds described in West German Patent No. 2,748,430, polyamine compounds described in JP-B No. 8836/1970, and bromide ion. Of these, in view of high acceleration effect, compounds having a mercapto group or a disulfido group are preferable, particularly preferably compounds described in U.S. Pat. No. 3,893,585, West German Patent No. 1,290,812, and JP-A No. 95630/1978. In addition, compounds described in U.S. Pat. No. 4,552,834 are also preferable. These bleach-accelerators may be added in the photographic material. These bleach-accelerators are used effectively in particular for bleach-fixing process of a color photographic material for photograph.

As fixing agents can be mentioned thiosulfate salts, thiocyanate salts, thioether-type compounds, thioureas, and many kinds of bromide salt. Of these, thiosulfate salts are used usually, and particularly ammonium thiosulfate can be used most widely. As a preservative for bleach-fixing solution sulfite salts, bisulfite salts, sulphinic acid- or carbonylbisulfuric acid-adducts are preferred.

The silver halide color photographic material of the present invention is generally passed through a washing step and/or a stabilizing step after the desilvering process. The amount of washing water in the washing step can be set in a wide range depending on the properties of the photographic material (for example, due to the material used, such as couplers), the uses of the photographic material, the temperature of the washing water, the number of washing tanks (number of washing steps), the type of replenishing mode, such as counter-current mode or concurrent mode, and other conditions. The relationship between the number of washing tanks and the amount of water in the multistage counter-current mode can be determined by a method described in *Journal of the Society of Motion Picture and Television Engineers*, Vol. 64, p. 248–253 (May, 1955).

With the multistage counter-current method described in the above-mentioned literature, the amount of washing water can be decreased considerably. However, bacteria propagate due to the increased time the water remains in the tanks, causing such problems as the adhesion of resulting suspended matter on the photographic material. To solve such problems in the present method of processing a color photographic material, a method of decreasing calcium and magnesium described in JP-A No. 288838/1987 can be used very effectively. Further, agents that can be used include isothiazolone and cyabendazole compounds described in JP-A No. 8542/1982, chlorine-type bactericides such as sodium chlorinated isocyanurate, benzotriazole, and other bactericides in Hiroshi Horiguchi *Bokinbobai no Kagaku, Sakkin, Bobai Gijutsu*, edited by Eiseigijutsu kai, and *Bokinbobaizai Jiten*, edited by Nihon Bokinbobai-gakkai.

The pH range of the washing water in the processing steps for the photographic material of the present invention may be 4 to 9, preferably 5 to 8. The temperature and time of washing, which can be set according to the use or property of the photographic material, is generally in the range 15 to 45° C. and 20 sec. to 10 min., preferably 25° to 40° C. and 30 sec. to 5 min. Further, the photographic materials of the present invention can be processed directly by a stabilizing solution without a washing step. In such a stabilizing process, all known methods described, for example, in JP-A Nos. 8543/1982, 14834/1983, and 220345/1985, can be used.

In some cases a stabilizing process is carried out following the above-described washing process, and an example of such cases is a stabilizing bath containing formalin and a surface-active agent for use as a final bath for color photographic materials for photographing. In this stabilizing bath various chelating agents or bactericides may be added.

The over-flowed solution accompanied by the above-described replenishing of washing water or stabilizing solution can be reused at desilvering step or so.

The silver halide color photographic material of the present invention may include a color developing agent for the sake of simplifying and quickening the developing process. For this purpose it is preferable to use a various precursor of color developing agent. As such precursors it can be mentioned, for example, indian aniline-series compounds described in U.S. Pat. No. 3,342,597, shiff base type compounds described in U.S. Pat. No. 3,342,599, *Research Disclosure* Nos. 14,850 and No. 15,159, aldol compounds described in *Research Disclosure* No. 13,942, complex salts of metal described in U.S. Pat. No. 13,942, complex salts of metal described in U.S. Pat. No. 3,719,492, and urethane compounds described in JP-A No. 135628/1978.

The silver halide color photographic material of the present invention may include each kind of 1-phenyl-3-pyrazilidone compounds for accelerating the color developing if needed. Examples of the compound are described in JP-A Nos. 64339/1981, 144547/1982, and 115438/1983.

In the present invention, each processing solution is used at a temperature of 10° to 50° C. although it is used usually at a temperature of 33° to 38° C. as standards, it can be used at higher temperature than the above-mentioned in order to accelerate the processing so as to shorten the processing time, or conversely at lower temperature to achieve improvements of image quality and of stability of processing solution. Further, in order to save silver in the photographic material a processing using cobalt intensification described in West German Patent No. 2,226,770 and U.S. Pat. No. 3,674,499 or peroxide intensification.

The method according to the present invention can be adopted to the processing of a color paper, color reverse paper, or color direct positive paper.

Next, details of the silver halide color photographic material for use in the present invention will be described below.

The content ratio of silver chloride in the silver halide emulsion of the present invention is 80 mol % or more, preferably 95 mol % or more, more preferably 98 mol % or more. In view of rapid processing, the higher the content of silver chloride the more preferable. Small amounts of silver bromide and/or silver iodide may be contained in the high-silver chloride emulsion of the present invention. In these cases, many useful effects on photo-sensitivity can be obtained, to increase the amount of light-absorption, increase the adsorption of spectrally-sensitizing dye, and to decrease the desensitization due to spectrally-sensitizing dye. Preferably, the halogen composition of silver halide in total photographic emulsion layer is 80 mol % or over.

In the present invention, preferably the blue-sensitive layer, the green-sensitive layer and the red-sensitive layer are silver halide emulsion layers comprising high silver chloride emulsion.

The silver halide grains to be used in the present invention may be of such a structure that the internal phase differs from the surface (core/shell grain), they may be polyphase with a joining structure, the entire grains may have a uniform phase, or a mixture thereof.

The average size of the silver halide grains (expressed in terms of the grain diameter for spherical or semi-spherical grains, the edge length for cubic grains, and the spherical grains, the edge length for cubic grains, and the spherical diameter for tabular grains, which can be determined as the average of the projected area diameter) is preferably smaller than 2 μm and larger than 0.1 μm, most preferably smaller than 1.5 μm and larger than 0.15 μm. The distribution of grain size may be either narrow or wide, but it is preferable in the present invention to use the so-called monodisperse emulsion of silver halide having a value (deviation coefficient) obtained by dividing the standard deviation calculated from the size distribution curve by the average grain size of 20% or less, most preferably 15% or less. In order to realize the gradation desired for the photographic material, two or more monodisperse silver halide emulsions (preferably all emulsions having the above-mentioned deviation coefficient) different in grain size may be mixed in a single layer or coated as different layers that have substantially the same color sensitivity. Further, two or more polydisperse silver halide emulsions or a combination of monodisperse and polydisperse emulsions can be employed as a mixture in one layer, or coated as different layers.

Silver halide grains for use in this invention may have a regular crystal structure such as cubic, hexahedral, rohmbic dodecahedral, or tetradecahedral, an irregular crystal structure such as spherical, or thereof composite crystal structure. Tabular grains may be employed wherein at least 50% of the total projected area of silver halide grains is tabular grains with a diameter-to-thickness ratio of about 5 or more, particularly of about 8 or more. Silver halide emulsions may be a mixture of various crystal structures. Silver halide grains may be used which form a latent image primary on the grain surface or in the interior of the grains.

In the present invention, the coating amount of silver halide is 1.5 g/m$^2$ or less, preferably 0.8 g/m$^2$ or less and 0.3 g/m$^2$ or more, in terms of silver. A coating amount of 0.8 g/m$^2$ or less is very preferable in view of rapidness, processing-stability, and storage-stability of image after processing (in particular, restraint of yellow stain). Further, the coating silver amount is preferably 0.3 g/m$^2$ or over, in view of image-density. From these points of view the coating amount of silver halide in terms of silver is more preferably 0.3 to 0.75 g/m$^2$, particularly preferably 0.4 to 0.7 g/m$^2$.

The photographic emulsion for use in the present invention can be prepared by the process described in *Research Disclosure* (RD) Vol. 176, Item No. 17643 (I, II, III) (December 1978).

Generally the emulsion to be used in the present invention may be physically ripened chemically ripened, and spectrally sensitized. Additives that will be used in these steps are described in *Research Disclosure* Vol. 176, No. 17643 (December 1978) and ibid. Vol. 187, No. 18716 (November 1978), and the involved sections are listed in the Table below.

Known photographic additives that can be used in the present invention are also described in the above-mentioned two *Research Disclosures*, and the involved sections are listed in the same Table below.

| | Additive | RD 17643 | RD18716 |
|---|---|---|---|
| 1 | Chemical sensitizer | p. 23 | p. 648 (right column) |
| 2 | Sensitivity-enhancing agents | p. 23 | p. 648 (right column) |
| 3 | Spectral sensitizers, | pp. 23–24 | pp. 648 (right column)-649 (right column) |
| 4 | Supersensitizers | | |
| 5 | Brightening agents | p. 24 | — |
| 6 | Coupler | p. 25 | |
| 7 | Organic solvent | p. 25 | |
| 8 | Light absorbers, and Filter dyes | pp. 25–26 | pp. 649 (right column)-650 (right column) |
| 9 | UV absorbers | | |
| 10 | Stain-preventive agents | p. 25 (right column) | p. 650 (left to right (column) |
| 11 | Image-dye stabilizers | p. 25 | — |
| 12 | Hardeners | p. 26 | p. 651 (left column) |
| 13 | Binders | p. 26 | p. 651 (left column) |
| 14 | Plasticizers and Lubricants | p. 27 | p. 650 (right column) |
| 15 | Coating aids and Surface-active agents | pp. 26–27 | p. 650 (right column) |
| 16 | Antistatic agents | p. 27 | p. 650 (right column) |

Various color couplers can be used in the present invention. Herein the term "color coupler" means a compound which can form dye by a coupling reaction with an oxidized aromatic primary amine developing agent. Typical and useful color couplers are naphthol or phenol compounds, pyrazolone or pyrazoloazol compounds, and open chain or heterocyclic ketomethylene compounds. Examples of these cyan, magenta and yellow couplers are disclosed in patents cited in *Research Disclosure* (RD) No. 17643 (December 1978), VII-D and ibid. No. 18717 (November 1979).

Color couplers for incorporation in the present photographic materials are preferably nondiffusible by being ballasted or polymerized. Two-equivalent couplers with a coupling-off group at the coupling-active position are more preferable than four-equivalent couplers having only hydrogen at the coupling position, in view of reduced silver coverage. Couplers can be employed in the present invention which form a dye of controlled image smearing or a colorless compound, as well as DIR couplers which release a development inhibiting reagent upon a coupling reaction, and couplers releasing a development accelerating agent.

Representative examples of yellow couplers useful in this invention include couplers of the oil-protected acylacetoamide type, as illustrated in U.S. Pat. Nos. 2,407,210, 2,875,057, and 3,265,506. Typical examples of two-equivalent yellow couplers preferable in this invention include yellow couplers having an oxygen-linked coupling-off group as illustrated in U.S. Pat. Nos. 3,408,194, 3,447,928, 3,933,501, and 4,022,620; yellow couplers having a nitrogen-linked coupling-off group as illustrated in JP-B No. 10739/1983, U.S. Pat. Nos. 4,401,752 and 4,326,024, *Research Disclosure* No. 18053 (April 1979), British Patent No. 1,425,020 and German Patent (OLS) Nos. 2,219,917, 2,261,351, and 2,433,812. Couplers of the α-pivaloyl-acetoanilide type are superior in the fastness of formed dye, particularly on exposure to light, while couplers of the α-benzoylacetoanilide type are capable of forming high maximum density.

Of these, acetoamide derivertives such as benzoyl acetoanilide and pivaloy acetoanilide are preferable.

In particular, compounds represented by the following formulae (Y-1) and (Y-2) are preferable as a yellow coupler:

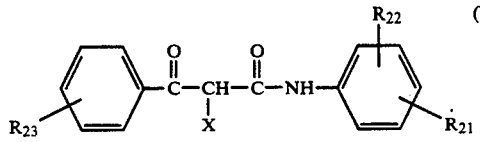

(Y-1)

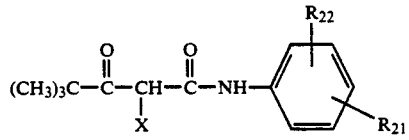

(Y-2)

wherein X represents a hydrogen atom or coupling split-off group (particularly nitrogen split-off groups are preferable than oxygen split-off groups); $R_{21}$ represents a diffusion-resist group having totally 8 to 32 carbon atoms; $R_{22}$ represents a hydrogen atom, one or more halogen atoms, a lower alkyl group, a lower alkoxy group, or a diffusion-resist group having totally 8 to 32 carbon atoms; $R_{23}$ represents a hydrogen atom or a substituent; and when $R_{22}$ is two or more in number they may be the same or different.

Details of pyvaloyl acetoanilide-type yellow couplers are described, for example, in U.S. Pat. Nos. 4,622,287 (from column 3 line 15 to column 8 line 39 of the specification) and 4,623,616 (from column 14 line 50 to column 19 line 41).

Details of benzoyl acetoanilide-type yellow couplers are described, for example, in U.S. Pat. Nos. 3,408,194, 3,933,501, 4,046,575, 4,133,958, and 4,401,752.

In addition to the coupler represented by formula (1) magenta couplers useful for this invention include oil-protected couplers of the indazolone or cyanoacetyl type, preferable of the 5-pyrazolone or pyrazoloazole (e.g., pyrazolotriazole) type. 5-Pyrazolones substituted by an arlamino or acylamino group at the 3-position are preferable in view of the hue and maximum densitives of the formed dyes, and they are illustrated in U.S. Pat. Nos. 2,311,082, 2,343,703, 2,600,788, 2,908,573, 3,062,653, 3,152,896, and 3,936,015. Preferable coupling-off groups in the two-equivalent 5-pyrazolone couplers are nitrogen-linked coupling-off groups described in U.S. Pat. No. 4,310,619, and an arylthio group described in U.S. Pat. No. 4,351,897. The ballast groups described in European Patent No. 73,636 have effects to enhance developed density in the 5-pyrazolone couplers.

Cyan couplers that can be used in this invention include naphthol couplers and phenol couplers of the oil-protected type. An example of a naphthol coupler is that disclosed in U.S. Pat. No. 2,474,293, and preferred examples of naphthol couplers are such two-equivalent naphthol couplers as the oxygen atom splitting-off type disclosed in U.S. Pat. Nos. 4,052,212, 4,146,396, 4,228,233, and 4,296,200. Examples of phenol couplers are those disclosed in U.S. Pat. Nos. 2,369,929, 2,801,171, 2,772,162, and 2,895,826.

Of these couplers, it is more preferable in the present invention to use the cyan coupler represented by formula (C) in red-sensitive emulsion layer, in view of the stability of photographic characteristics during the continuous processing.

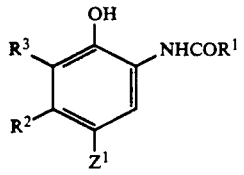

Formula (C)

wherein $R^1$ represents an alkyl group, cycloalkyl group, aryl group, amino group, or heterocyclic group, $R^2$ represents an acylamino group or alkyl group containing more than 2 carbon atoms, $R^3$ represents a hydrogen atom, halogen atom, alkyl group, or alkoxy group, $R^3$ may form a ring by being combined with $R^2$, $Z^1$ represents a hydrogen atom, halogen atom, or group capable of splitting-off by a coupling reaction with an oxidized aromatic primary amine main color developing agent.

In formula (C), a preferred alkyl group represented by $R^1$ is an alkyl group containing 1 to 32 carbon atoms, e.g., methyl, butyl, tridecyl, cyclohexyl and allyl; an aryl group, including a phenyl and naphthyl; and a heterocyclic group, including 2-pirizyl and 2-furyl. When $R^1$ is a amino group, a phenyl-substituted amino group which may have a further substituent is especially preferable.

$R^1$ may further be substituted by a substituent selected from a group comprising an alkyl group, aryl group, alkyl- or aryl-oxy group (e.g., methoxy, dodecyloxy, methoxyethoxy, phenyloxy, 2,4-di-tert-amylphenoxy, 3-tert-butyl-4-hydroxyphenyloxy, or naphthyloxy), carboxy group, alkyl- or aryl-carbonyl group (e.g., acethyl, tetradecanoyl, or benzoyl), alkyl- or aryloxycarbonyl group (e.g., methoxycarbonyl or phenoxycarbonyl), acyloxy group (e.g., acetyl or benzoyloxy), sulfamoyl group (e.g., N-ethylsulfamoyl or N-octadecylsulfamoyl), carbamoyl group (e.g., N-ethylcarbamoyl or N-methyldodecylcarbamoyl), sulfonamido group (e.g., mathanesulfonamido or benzenesulfonamido), acylamino group (e.g., acetylamino, benzamino, ethoxycarbonylamino or phenylaminocarbonylamino), imido group (e.g., succinimido or hydantoinyl), sulfonyl group (e.g., methanesulfonyl), hydroxyl group, cyano group, nitro group, and a halogen atom.

$Z^1$ in formula (C) represents a hydrogen atom or a coupling-off group, e.g., a halogen atom (e.g., fluorine, chlorine, or bromine), an alkoxy group (e.g., dodecyloxy, methoxycarbamoylmethoxy, carboxypropyloxy, or methylsulfonylethoxy), an aryloxy group (e.g., acetoxy, tertradecanoyloxy, or benzoloxy), a sulfonyloxy group (e.g., methanesulfonyloxy or toluensulfonyloxy), an amido group (e.g., dichloroacetylamino, methanesulfonylamino, or toluenesulfonylamino), an alkoxycarbonyloxy group (e.g., ethoxycarbonyloxy or benzyloxycarbonyloxy), aryloxycarbonyloxy group (e.g., phenoxycarbonyloxy), an aliphatic or aromatic thio group (e.g., phenylthio or tetrazoylthio), an imido group (e.g., succinimido or hydantoinyl), N-heterocyclic ring (e.g., 1-pyrazolyl or 1-benztriazolyl), or an aromatic azo group (e.g., phenylazo). These coupling-off groups may contain a photographically useful group or groups.

$R^1$ or $R^2$ in formula (C) may form a dimer or polymer.

Specific examples of the cyan couplers represented by the forgoing formula (C) are illustrated below, which, however, should not be construed as limiting the more preferable cyan couplers of the present invention.

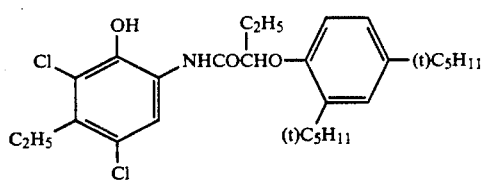

(C-1)

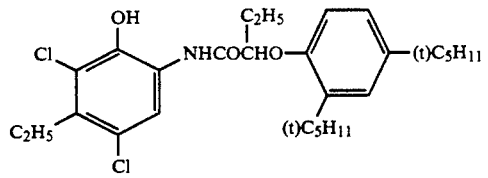

(C-2)

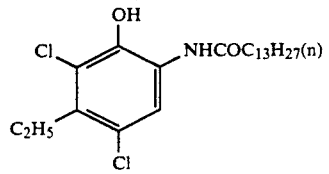

(C-3)

-continued
(C-4)
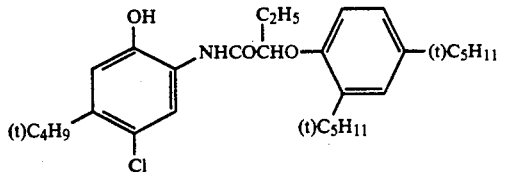
(C-5)
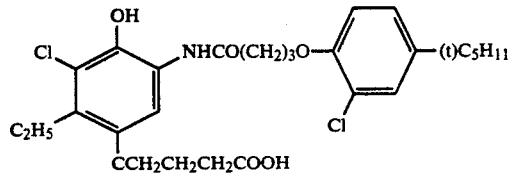
(C-6)
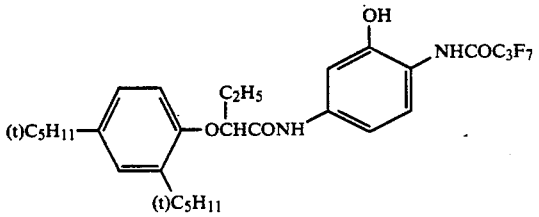
(C-7)
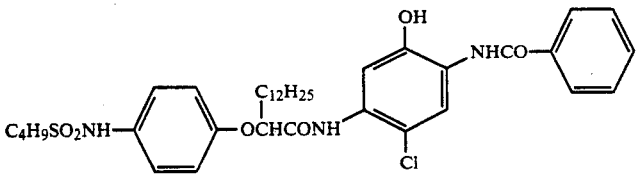
(C-8)
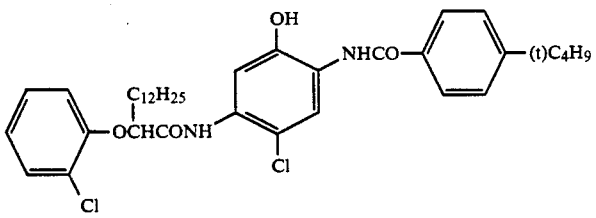
(C-9)
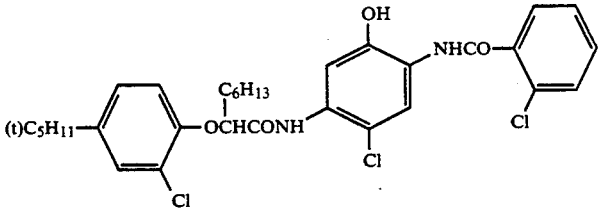
(C-10)
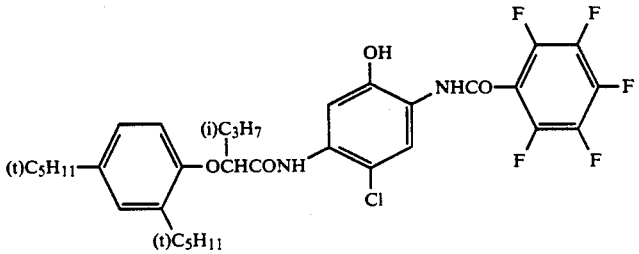

-continued
(C-11)
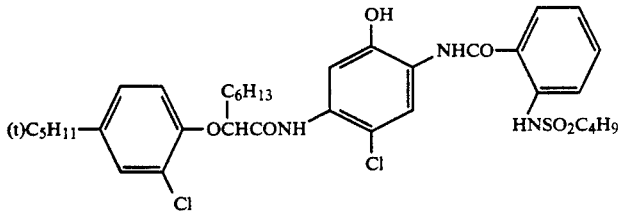
(C-12)
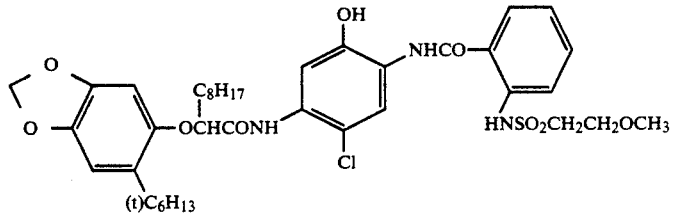
(C-13)
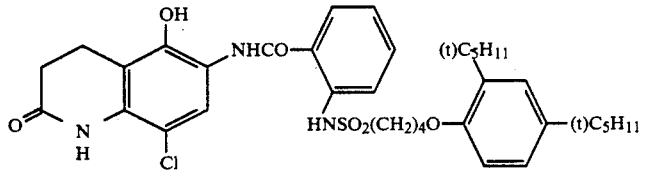
(C-14)
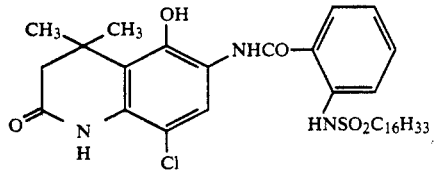
(C-15)
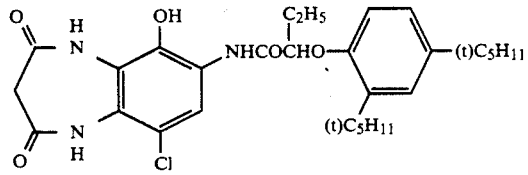
(C-16)
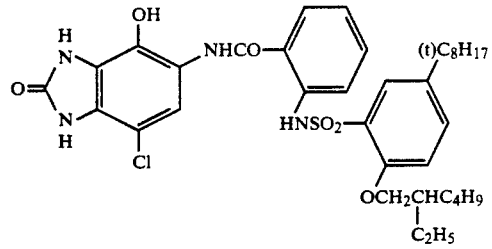
(C-17)
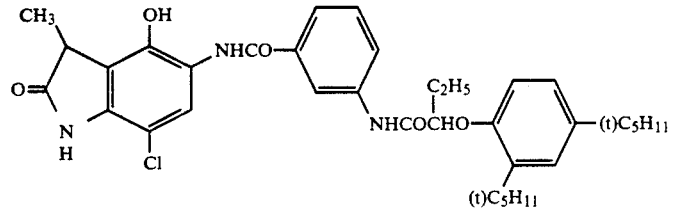

-continued
(C-18)
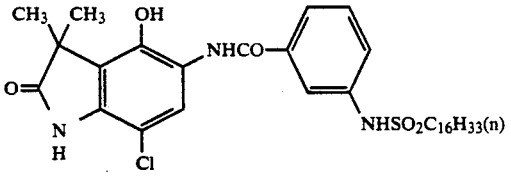
(C-19)
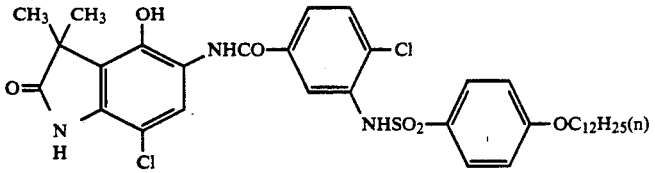
(C-20)
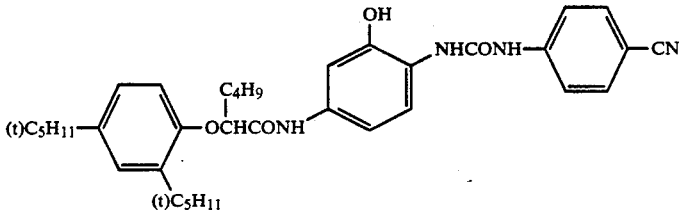
(C-21)
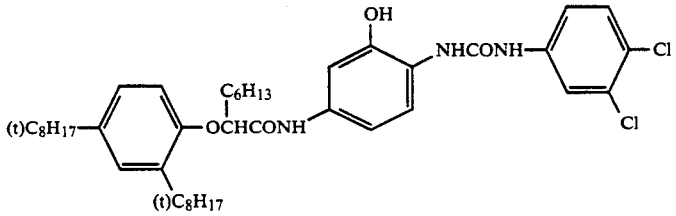
(C-22)
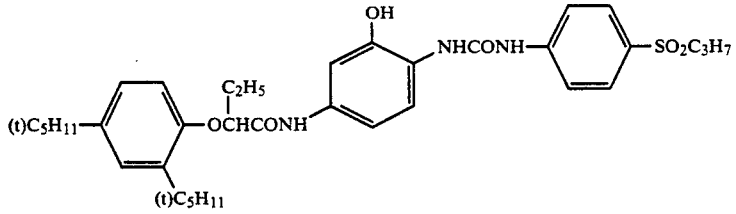
(C-23)
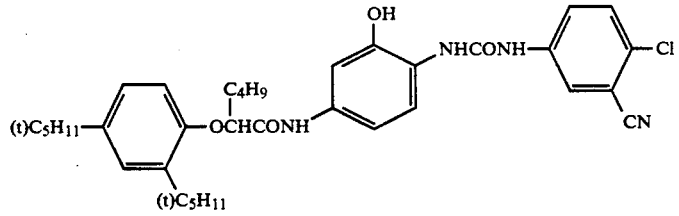
(C-24)
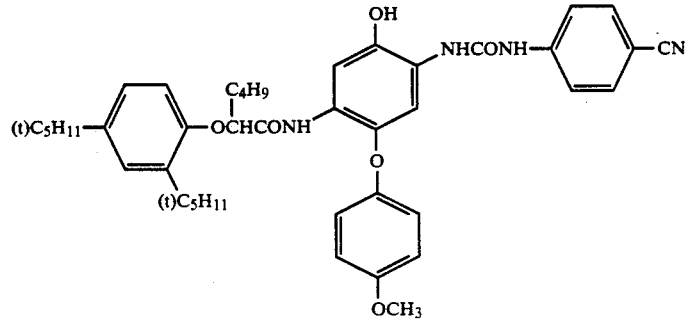

-continued (C-25)

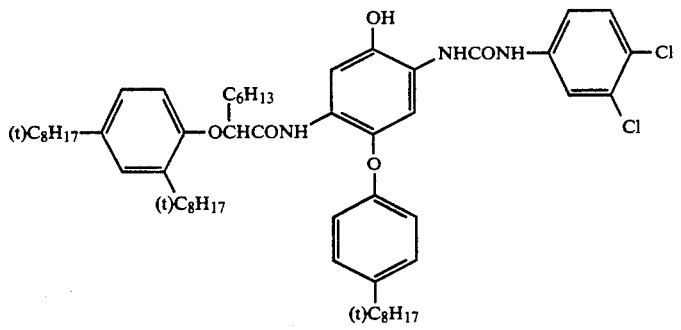

(C-26)

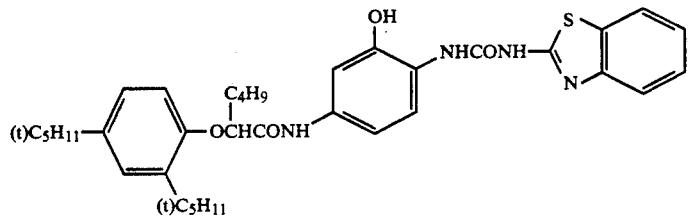

The cyan couplers represented by above-described formula (C) can be synthesized according to the description in JP-A No. 166956/1984 and JP-B No. 11572/1974.

It is possible to improve the graininess by using color couplers in combination with a coupler that forms a dye with a proper degree of diffusion. A magenta coupler of such dye-diffusing type is disclosed in U.S. Pat. No. 4,366,237 and British Patent No. 2,125,570; and a similar type or yellow, magenta, or cyan coupler is disclosed in European Patent No. 96,570 and German Patent (OLS) No. 3,234,533.

The dye-forming couplers and the special couplers described above may be dimeric, oligomeric, or polymeric. Examples of polymerized dye-forming couplers are disclosed in U.S. Pat. Nos. 3,451,820 and 4,080,211. Examples of polymerized magenta couplers are disclosed in British Patent No. 2,102,173 and U.S. Pat. No. 4,367,282.

In order to satisfy the characteristics desired for the photographic materials, various couplers used in the present invention can be employed as a combination of two or more couplers in a light-sensitive layer, or the same compound can be employed in two or more layer.

The couplers to be used in the present invention can be incorporated to photographic materials by various known dispersing processes.

Usually the color couplers are used in an amount of 0.001 to 1 mol per mol of photosensitive silver halides. The preferred amounts of coupler are 0.01 to 0.5 mol for yellow coupler, 0.003 to 0.3 mol for magenta coupler, and 0.02 to 0.3 mol for cyan coupler.

In the present invention it is preferably to use the following compounds together with the above-mentioned couplers for example, in view of preventing the occurrence of stain and other side effects during preservation after processing due to the formation of colored dye by a reaction between the developing agent or its oxidized product and the coupler remained. In particular, the use together with a pyrazoloazole coupler is preferable.

That is, the use of compound (F) that can combine chemically with the aromatic amine developing agent remaining after the color development processing to produce a chemically inactive and substantially colorless compound, and a compound (G) that can combine chemically with the oxidized product of the aromatic amine developing agent remaining after the color development processing to produce a chemically inactive and substantially colorless compound is preferable. Compounds (F) and (G) can be used solely or in combination with each other.

Preferable ones of the compound (F) are those that can react with the rate constant $K_2$ of the second-order reaction (in trioctyl phosphate at 80° C.) with p-anisidine within the range of 1.0 l/mol.sec to $1\times10^{-5}$ l/mol.sec. The secondary rate constant of the reaction can be determined by the method described in JP-A No. 158545/1988.

If the $K_2$ is too great the compounds themselves become unstable and react with gelatin and water to decompose. On the other hand, if the $K_2$ is too small the reaction of the compounds with the aromatic amine developing agent is slow, as a result the side effect of remaining aromatic amine developing agent cannot be prevented.

The more preferable ones of the compound (F) can be represented by the following formula (FI) or (FII):

$$R_1-(A)_n-X \qquad \text{Formula (FI)}$$

$$R_2-\underset{\underset{B}{|}}{C}=Y \qquad \text{Formula (FII)}$$

wherein $R_1$ and $R_2$ each represent an aliphatic group, an aromatic group, or a heterocyclic group, X represents a group that can react with the aromatic amine developing agent to split off, A represents a group that can react with the aromatic amine developing agent to form a chemical bond, n is 1 or 0, B represents a hydrogen atom, an aliphatic group, an aromatic group, a heterocyclic group, or an acyl or a sulfonyl group, Y represents a group that can facilitate the addition of the aromatic amine developing agent to the compound having formula (FII), and $R_1$ and X together or Y and $R_2$ or B together may combine to form a ring structure.

Of ways wherein the remaining aromatic amine developing agent and the compound (F) chemically combine, typical ways are substitution reactions and addition reactions.

Concrete examples of compounds represented by formulae (FI) and (FII) are described in, for example, JP-A Nos. 158545/1983 and 283338/1987, and Japanese Patent Application Nos. 158342/1987 and 18439/1988.

On the other hand, more preferable examples of the compound (G) that combine chemically with the oxidized product of the aromatic amine developing agent after the color development processing to produce a chemically inactive and colorless compound are those represented by the following formula (GI):

R-Z (Formula (GI))

wherein R represents an aliphatic group, an aromatic group, or a heterocyclic group and Z represents a nucleophilic group or a group that can split off a nucleophilic group by decomposition in the photosensitive material. The compounds represented by formula (GI) are preferably groups having a Pearson's nucleophilic "$CH_3I$ value (R. G. Pearson, et al., *J. Am. Chem. Soc.* 90, 319 (1968)) of 5 or more, or groups derived from them.

Concrete examples of compound represented by formula (GI) are preferably those described in, for example, European Patent (laid open) No. 255722, JP-A Nos. 143048/1987 and 229145/1987, and Japanese Patent Application Nos. 18439/1988, 136724/1988, 214681/1987, and 158342/1987. And details of the combination of the compound (G) and the compound (F) are described in Japanese Patent Application No. 18439/1988.

The photographic materials to be used in the present invention are those applied on usual flexible bases such as plastics films (e.g., cellulose nitrate, cellulose acetate, or polyethyleneterephtalate), paper, or on a rigid base, such as a glass plate. Details of the base and the method of application are described in *Research Disclosure*, Item 17643, XV (p. 27) and XVII (p. 28) (December 1978).

In this invention a reflective base may be preferably used. The "reflective base" can increase the reflectivity and make clear the dye image formed in a silver halide emulsion layer. Such a reflective base includes a base coated with a hydrophobic resin that contains a light reflecting material such as titanium oxide, zinc oxide, calcium carbonate, and calcium sulfate.

The invention will now be described in further detail with reference to examples, but the invention is not limited to the following examples.

EXAMPLE 1

A multilayer color photographic paper A was prepared by coating layers as hereinbelow described on a paper laminated on both sides with polyethylene.

Coating solutions were prepared by mixing and dissolving an emulsion, each of chemicals, and an emulsified dispersion, of which each preparation procedure is described below.

Preparation of the coupler emulsion

To a mixture of 19.1 g of yellow coupler (ExY) and 4.4 g of an image-dye stabilizer (Cpd-1), 27.2 ml of ethyl acetate and 7.7 ml of a solvent (Solv-1) were added and dissolved. The resulting solution was emulsified and dispersed in 185 ml of 10% gelatin solution containing 8 ml of sodium dodecylbenzensulfonate.

According to this procedure each emulsion of magenta coupler, cyan coupler, and intermediate layer was prepared.

The compounds used for each emulsion were as follows:

(ExY) Yellow coupler

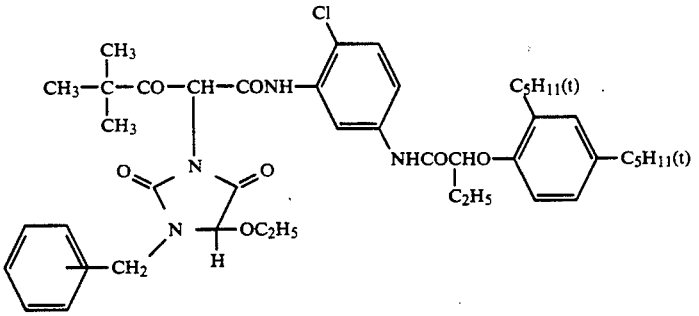

(ExM) Magenta coupler: See Table 1

(ExC1) C-1

(ExC2) C-9

(Cpd-1) Image-dye stabilizer

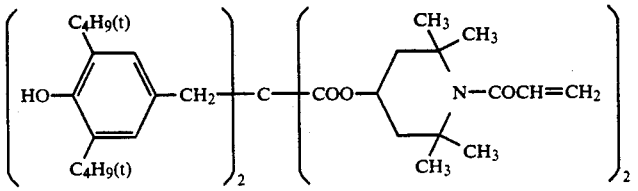

(Cpd-2) Color-mix inhibitor

-continued
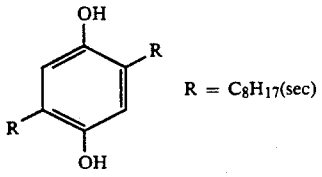
(Cpd-3)
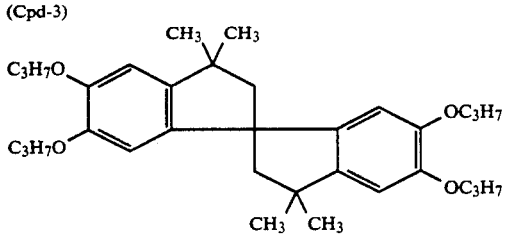
(Cpd-4)
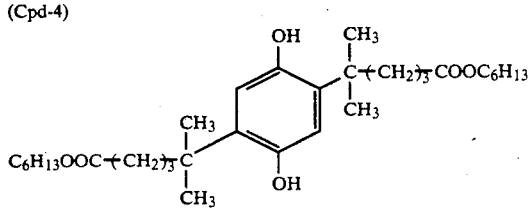
(Cpd-5) Color-mix inhibitor
The same as (Cpd-2), except that R = $C_8H_{17}$(t)
(Cpd-6) Image dye stabilizer
Blend of 6a:6b:6c = 5:8:9 (in weight ratio)
6a
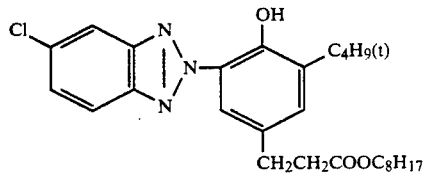
6b
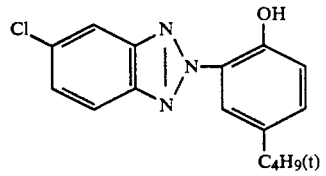
6c
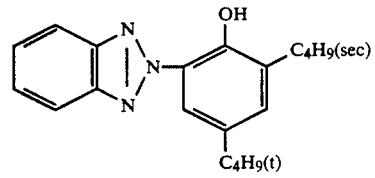
(Cpd-7) Polymer
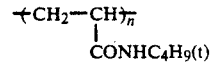
(av. molecular weight: 80,000)
(UV-1) UV absorber
Blend of 6a:6b:6c (of Cpd-6) = 2:9:8 (in weight ratio)
(Solv-1) Solvent -continued

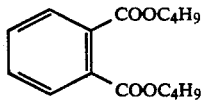

(Solv-2) Solvent
$O{=}P{-}(O{-}C_8H_{17}(iso))_3$ (Solv-3) Solvent
$O{=}P{-}(O{-}C_9H_{19}(iso))_3$ (Solv-4) Solvent

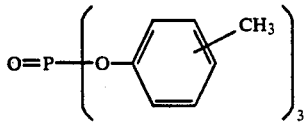

The following dyes were used to prevent the respective emulsion layer from irradiation.

Red-sensitive emulsion layer: Dye-R

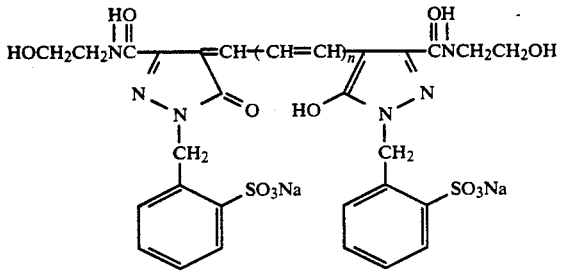

wherein n = 2

Green-sensitive emulsion layer:

The same as Dye-R, except that n = 1

To the red-sensitive emulsion layer, the following compound was added in an amount of $2.6\times10^{-3}$ mol per mol of silver halide.

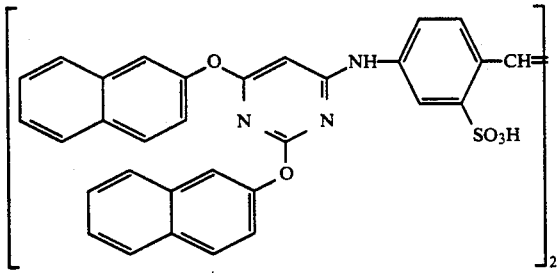

Next, the preparation procedure of emulsions used in this Example will be described below.

Blue-sensitive Emulsion: A monodisperse silver chloride emulsion of cubic crystalline grains (containing $K_2IrCl_6$ and 1,3-dimethylimidazoline-2-thione) having an average grain size of 1.1 μm, and a deviation coefficient (the value obtained by dividing the standard deviation by average grain size = s/d) of 0.10 was prepared in the usual way. To 1.0 kg of the thus-prepared emulsion was added 26 ml of a 0.6% solution of a blue spectral sensitizing dye (S-1), and an emulsion of 0.05 μm silver bromide fine grains was further added thereto in a ratio of 0.5 mol % with respect to the host silver chloride emulsion. After ripening, sodium thiosulfate was added thereto and optimum chemical sensitization was then achieved, and a stabilizer (see Table 1) was added thereto in a proportion of $10^{-4}$ mol per mol of Ag in order to prepare a blue-sensitive emulsion.

Green-sensitive Emulsion: Silver chloride grains containing $K_2IrCl_6$ and 1,3-dimethylimidazoline-2-thione were prepared in the usual way, and a sensitizing dye (S-2) was added thereto in a ratio of $4\times10^{-4}$ mol per mol of Ag. KBr was further added thereto, and after ripening, sodium thiosulfate was added thereto and optimum chemical sensitization was then achieved. A stabilizer (Stb-1) was added thereto in a ratio of $5\times10^{-4}$ mol per mol of Ag in order to prepare a monodisperse cubic silver chloride emulsion having an average grain size of 0.48 μm and a deviation coefficient of 0.10.

Red-sensitive Emulsion: An emulsion was prepared by repeating the same procedure for the green-sensitive emulsion, except that the sensitizing dye was changed to dye (S-3) in an additive amount of $1.5\times10^{-4}$ mol per mol of silver halide.

The compounds used are shown below.

(S-1) Sensitizing dye

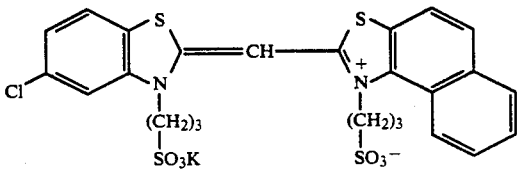

(S-2) Sensitizing dye

-continued

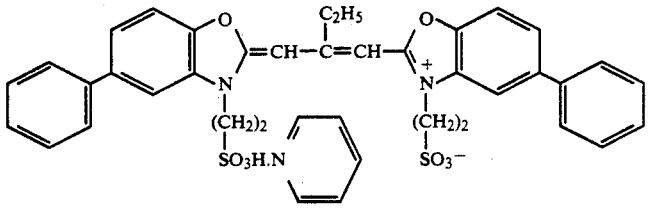

(S-3) Sensitizing dye

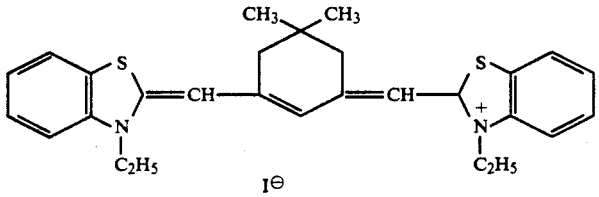

(Stb-1) Stabilizer

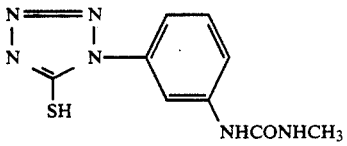

Compositions of layers

The compositions of the layers were as follows. The values represent the coating amount in g/m$^2$. The amount of each silver halide emulsion is represented by the coating amount in terms of silver.

Rase: Polyethylene-laminated paper (a white pigment, $TiO_2$, and a bluish dye, ultramarine, were included in the polyethylene film of the first layer side)

| | |
|---|---|
| First layer: Blue-sensitive emulsion layer | |
| Silver halide emulsion | 0.25 |
| Gelatin | 1.86 |
| Yellow coupler (ExY) | 0.82 |
| Image-dye stabilizer (Cpd-1) | 0.19 |
| Solvent (Solv-1) | 0.35 |
| Second layer: Color-mix-preventing layer | |
| Gelatin | 0.99 |
| Color-mix inhibitor (Cpd-2) | 0.08 |
| Third layer: Green-sensitive emulsion layer | |
| Silver halide emulsion | 0.31 |
| Gelatin | 1.24 |
| Magenta coupler (ExM) | shown in Table 1 |
| Image-dye stabilizer (Cpd-3) | 0.25 |
| Image-dye stabilizer (Cpd-4) | 0.12 |
| Solvent (Solv-2) | 0.42 |
| Fourth layer: Ultraviolet-absorbing layer | |

-continued

| | |
|---|---|
| Gelatin | 1.58 |
| Ultraviolet absorbent (UV-1) | 0.62 |
| Color-mix inhibitor (Cpd-5) | 0.05 |
| Solvent (Solv-3) | 0.24 |
| Fifth layer: Red-sensitive emulsion layer | |
| Silver halide emulsion | 0.21 |
| Gelatin | 1.34 |
| Cyan coupler (a blend of ExC1 and ExC2 in a ratio of 1:1) | 0.34 |
| Image-dye stabilizer (Cpd-6) | 0.17 |
| Polymer (Cpd-7) | 0.40 |
| Solvent (Solv-4) | 0.23 |
| Sixth layer: Ultraviolet-absorbing layer | |
| Gelatin | 0.53 |
| Ultraviolet absorbent (UV-1) | 0.21 |
| Solvent (Solv-3) | 0.08 |
| Seventh Layer: Protective Layer | |
| Gelatin | 1.33 |
| Acrylic-modified (modification degree: 17%) copolymer of poly(vinyl alcohol) | 0.17 |
| Liquid paraffin | 0.03 |

The sodium salt of 1-oxy-3,5-dichloro-s-triazine was used as hardening agent for each layer.

Samples B to G were prepared in the same manner as Sample A except that the magenta coupler was changed as shown in Table 1, respectively.

TABLE 1

| Sample | A | B | C | D | E | F | G |
|---|---|---|---|---|---|---|---|
| Coupler | M-74 | M-75 and M-76 | | M-37 | M-43 | M-45 | M-68 |
| Amount | | | $5.0 \times 10^{-4}$ mol/m$^2$ | | | | |

(M-74)

TABLE 1-continued

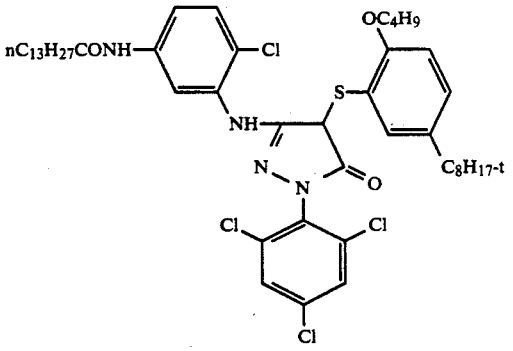

(M-75)

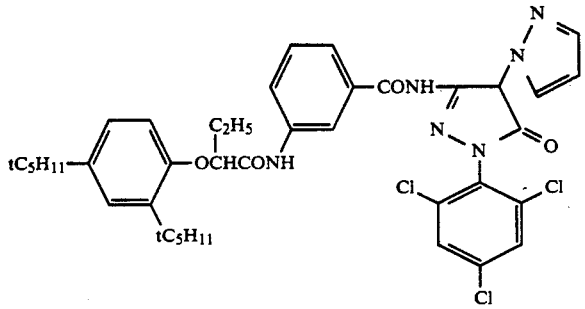

(M-76)

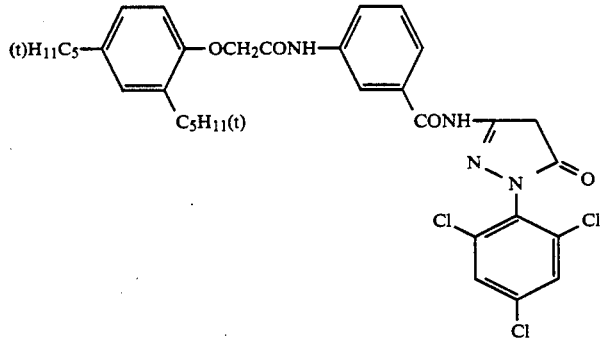

These coated samples were subjected to the following experiment to evaluate their photographic characteristics.

First, each of the coated samples was subjected to a gradational exposure of light for a sensitometry using a sensitometer (FWH-type, made by Fuji Photo Film Co., Ltd., color temperature at light source: 3200 K.). The exposure was conducted to give an exposure time of one-tenth second and an exposure amount of 250 CMS.

Next, after gradational exposure of light, the coated samples were subjected to continuous processing (running test) according to the processing steps described below using the processing solutions described below until the color-developer volume replenished is twice as much as the tank volume. The composition of the color-developer was changed as shown in Table 2, and each developer was subjected to the running test.

| Processing step | Temperature (°C.) | Time (sec.) | Replenisher Amount (ml)* | Tank (l) |
|---|---|---|---|---|
| Color-developing | 38 | 55 | 65 | 6 |
| Bleach-fixing | 30–36 | 45 | 161 | 8 |

-continued

| Processing step | Temperature (°C.) | Time (sec.) | Replenisher Amount (ml)* | Tank (l) |
|---|---|---|---|---|
| Rinsing ① | 30–37 | 20 | — | 4 |
| Rinsing ② | 30–37 | 20 | — | 4 |
| Rinsing ③ | 30–37 | 20 | — | 4 |
| Rinsing ④ | 30–37 | 20 | 200 | 4 |
| Drying | 70–80 | 60 | | |

*Replenisher amount per $m^2$ of photographic material (Rinsing steps were carried out in a four-tank cascade mode from tank of rinsing ④ toward tank of rinsing ①.)

The composition of the processing solutions were as follows:

| | Tank solution | Replenisher |
|---|---|---|
| Color-Developing Solution | | |
| Water | 800 ml | 800 ml |
| Benzyl alcohol | See Table 2 | |
| Ethylenediamine-N,N,N,N-tetramethylenephosphonate | 3.5 g | 6.5 g |
| Organic preservative A (VIII-1) | 0.04 mol | 0.08 mol |
| Sodium chloride | 4.6 g | 0.0 g |
| Potassium carbonate | 25 g | 25 g |

-continued

| | Tank solution | Replenisher |
|---|---|---|
| N-Ethyl-N-(β-methanesulfonamido-ethyl)-3-methyl-4-aninoaniline sulfate | 5.0 g | 12.0 g |
| Organic preservative B (XIV-1) | 0.05 mol | 0.07 mol |
| Fluorescent brightening agent (4,4-diaminostilbene series) | 2.0 g | 4.0 g |
| Water to make | 1000 ml | 1000 ml |
| pH (25° C.) | 10.05 | 10.85 |
| Bleach-Fixing Solution | | |
| (Both the tank solution and replenisher are the same) | | |
| Water | | 400 ml |
| Ammonium thiosulfate (70%) | | 100 ml |
| Sodium sulfite | | 17 g |
| Iron (III) ammonium ethylenediamine-tetraacetate | | 55 g |
| Disodium ethylenediaminetetraacetate | | 5 g |
| Ammonium bromide | | 40 g |
| Glacial acetic acid | | 9 g |
| Water to make | | 1000 ml |
| pH (25° C.) | | 5.40 |
| Rinsing Solution | | |
| (Both the tank solution and replenisher are the same) | | |
| Ion-exchanged water | (each content of calcium and magnesium was 3 ppm or less) | |

At the beginning and the end of the running test, each sample was subjected to the above-described sensitometry, and then the minimum densities (Dmin) and the maximum densities (Dmax) of green (G), and the sensitivity (log E at density 0.5) were determined by using a Macbeth densitometer. The results are shown in Table 2. In the Table, + represents the increase of sensitibity and −represents the decrease of sensitivity.

At the same time, in order to evaluate the yellow stain after processing, each of unexposed samples was processed at the end of the running test, and stored under the condition of temperature 80° C. and relative humidity 70% for 10 days. Then the changes after the storage were tested. The results are shown in Table 2.

TABLE 2

| Processing Process | (1) | (2) | (3) | (4) | (5) | (6) | (7) | (8) | (9) | (10) |
|---|---|---|---|---|---|---|---|---|---|---|
| Photographic Material | A | A | B | C | D | D | E | F | G | G |
| Benzyl alcohol (ml/l) | | | | | | | | | | |
| Tank solution | — | 14.0 | — | — | — | 14.0 | — | — | — | 14.0 |
| Replenisher | — | 36.0 | — | — | — | 36.0 | — | — | — | 36.0 |
| Remarks | Comparative Example | | | | | This Invention | | | | |
| GL $\Delta D_{min}$ | +0.10 | +0.07 | +0.07 | +0.09 | +0.01 | +0.03 | 0 | 0 | 0 | +0.02 |
| GL $\Delta D_{max}$ | +0.25 | +0.20 | +0.24 | +0.22 | +0.01 | +0.01 | +0.02 | +0.01 | −0.01 | +0.01 |
| GL ΔSensitivity | −0.16 | −0.12 | −0.17 | −0.15 | 0 | −0.02 | 0 | 0 | −0.01 | −0.02 |
| Yellow Stain | +0.15 | +0.14 | +0.14 | +0.24 | +0.06 | +0.09 | +0.04 | +0.04 | +0.03 | +0.09 |

As is apparent from the results in Table 2, when a photographic material not containing the magenta coupler represented by formula (I) is used, as shown in the processing processes (1) to (4), there were caused large changes in minimum density, maximum density, and sensitivity of magenta coloring layer (GL) between the beginning and the end of the running test and the increase of yellow stain after processing was remarkable.

However, when a photographic material containing the magenta coupler represented by formula (I) is used, as shown in the processing processes (5) to (10), the changes in the photographic characteristics of magenta coloring layer (GL) during the running were apparently decreased, and the yellow strain after processing was remarkably restrained. Thus according to the present invention it becomes to be possible to attain both good stability in a processing and good preservability of image at the same time, remarkably decreasing the replenishing amount of color-developing solution.

Further, it is understood that, as shown in the processing processes (5) and (7) to (9), not containing benzyl alcohol in the color-developing solution is more preferable in the present invention, in view of the stability of photographic characteristics during continuous processing and the image-stability after processing.

EXAMPLE 2

When a process was repeated in the same manner as in Example 1, except that M-37 of the photographic material D in the processing process (5) was changed to M-3, M-13, M-23, M-39, M-42, and M-54, respectively, the same preferable results were obtained in all cases.

EXAMPLE 3

The similar photographic materials A to G as in Example 1 were subjected to a continuous processing (running test) in the processing steps described below using processing solutions of which composition are described below, until the replenisher-amount of developing solution comes to twice the volume of color-developing tank, provided that the composition of color developing solution was changed as shown in Table 3.

| Processing step | Temperature (° C.) | Time (sec.) | Replenisher Amount (ml)* | Tank (l) |
|---|---|---|---|---|
| Color-developing | 37 | 60 | 40 | 6 |
| Bleach-fixing | 30–36 | 45 | 161 | 8 |
| Rinsing (1) | 30–37 | 20 | — | 4 |
| Rinsing (2) | 30–37 | 20 | — | 4 |
| Rinsing (3) | 30–37 | 20 | — | 4 |
| Rinsing (4) | 30–37 | 30 | 200 | 4 |
| Drying | 70–80 | 60 | | |

*Replenisher amount per $m^2$ of photographic material (Rinsing steps were carried out in a four-tank cascade mode from tank of rinsing (4) toward tank of rinsing (1).)

The composition of the processing solutions were as follows:

| Color-Developing Solution | Tank solution | Replenisher |
|---|---|---|
| Water | 800 ml | 800 ml |
| Ethylenediamine-N,N,N,N-tetramethylenephosphonate | 3.5 g | 8.0 g |
| Organic preservative A | 0.04 mol | 0.09 mol |
| Sodium chloride | 5.0 g | 0.0 g |
| Potassium carbonate | 25 g | 25 g |
| N-Ethyl-N-(β-methanesulfonamido-ethyl)-3-methyl-4-aminoaniline sulfate | 5.0 g | 11.0 g |
| Organic preservative B | 0.06 mol | 0.09 mol |
| Fluorescent whitening | 2.0 g | 4.0 g |

-continued

| Color-Developing Solution | Tank solution | Replenisher |
|---|---|---|
| agent (4,4-diaminostilbene series) | see Table 3 | |
| Sodium sulfite | | |
| Water to make | 1000 ml | 1000 ml |
| pH (25° C.) | 10.25 | 10.90 |

At the beginning and the end of the running test, each sample was subjected to the above-described sensitometry, and then the changes of the minimum density (Dmin), the maximum density (Dmax), and the sensitivity (log. E at density 0.5) of each layer due to the continuous process were determined using a Macbeth densitometer. The results are shown in Table 2. In the Table, + represents the increase of sensitivity, and − represents the decrease of sensitivity.

At the same time, in order to evaluate the yellow stain after processing, each of unexposed samples was processed at the end of the running test, and stored under the condition of temperature 80° C. and relative humidity 70% for 10 days. Then the changes after the storage were tested. The results are shown in Table 3.

TABLE 3

| Processing Process | ① | ② | ③ | ④ | ⑤ | ⑥ | ⑦ | ⑧ | ⑨ | ⑩ | ⑪ |
|---|---|---|---|---|---|---|---|---|---|---|---|
| Photographic Material | A | B | C | D | D | D | D | E | F | G | G |
| Organic Preservative A | VIII-1 | Hydroxylamine | Hydroxylamine | VIII-1 | VIII-1 | Hydroxylamine | X-19 | VII-1 | X-19 | X-21 | Hydroxylamine |
| Organic Preservative B | XVI-1 | — | Sodium Sulfite | XVI-1 | Sodium Sulfite | Sodium Sulfite | XIV-1 | IXV-1 | XIV-1 | XIV-1 | XIV-1 |
| Remarks | Comparative Example | | | | | | This Invention | | | | |
| BL $\Delta D_{min}$ | +0.09 | +0.10 | +0.09 | 0 | +0.02 | +0.03 | 0 | 0 | 0 | 0 | +0.03 |
| BL $\Delta D_{max}$ | +0.25 | +0.24 | +0.27 | +0.03 | +0.08 | +0.09 | −0.01 | +0.01 | +0.01 | +0.01 | +0.09 |
| BL ΔSensitivity | −0.19 | −0.26 | −0.30 | −0.01 | −0.04 | −0.06 | 0 | 0 | −0.01 | 0 | −0.05 |
| GL $\Delta D_{min}$ | +0.08 | +0.09 | +0.10 | 0 | +0.01 | +0.03 | +0.01 | 0 | 0 | 0 | +0.03 |
| GL $\Delta D_{max}$ | +0.24 | +0.22 | +0.19 | +0.02 | +0.07 | +0.09 | +0.01 | +0.01 | +0.02 | +0.02 | +0.08 |
| GL ΔSensitivity | −0.25 | −0.36 | −0.37 | −0.01 | −0.03 | −0.02 | 0 | 0 | 0 | −0.01 | −0.04 |
| RL $\Delta D_{min}$ | +0.10 | +0.09 | +0.09 | 0 | +0.02 | +0.02 | 0 | 0 | +0.01 | 0 | +0.02 |
| RL $\Delta D_{max}$ | +0.26 | +0.29 | +0.19 | +0.01 | +0.09 | +0.09 | +0.01 | 0 | 0 | +0.01 | +0.08 |
| RL ΔSensitivity | −0.14 | −0.22 | −0.18 | 0 | −0.04 | −0.06 | 0 | −0.01 | 0 | 0 | −0.06 |
| Yellow Stain* | +0.18 | +0.20 | +0.27 | +0.09 | +0.11 | +0.12 | +0.06 | +0.05 | +0.05 | +0.04 | +0.11 |

*Yellow stain after processing

As is apparent from the results in Table 3, when a photographic material not containing the magenta coupler represented by formula (I) is used, as shown in the processing processes ① to ③, there were caused large changes in minimum density, maximum density, and sensitivity between the beginning to the end of the running test, and remarkable increase of yellow stain after processing was observed.

However, when a photographic material containing the magenta coupler represented by formula (I) is used, as shown in the processing processes ④ to ⑪, the changes in the photographic characteristics during the running test were apparently decreased, and yellow stain after processing was remarkably restrained. Thus according to the present invention it becomes to be possible to attain both good stability in a processing and good preservability of image at the same time, remarkably decreasing the replenishing amount of color-developing solution.

Further, it is understood that, as shown in the processing processes ④ and ⑦ to ⑪, not to contain sulfite in the color-developing solution is more preferable, and as shown in the processing processes ④, ⑤, and ⑦ to ⑩, not to contain hydroxylamine in the color-developing solution is more preferable. Among these, as shown in the processing processes ④ and ⑦ to 10 , not to contain sulfite and hydroxylamine and to contain a organic preservative in the color-developing solution is further more preferable in view of the processing stability and the image-preservability after processing.

EXAMPLE 4

When a process was repeated in the same manner as in Example 3, except that the compound VIII-1 of the organic preservative A in the processing process ④ was changed to VIII-2, IX-7, X-15, XI-5, XII-1, or XIII-5, the same preferable results were obtained in all cases. Further, when the compound XIV-1 of the organic preservative B in the processing process ⑨ was changed to XV-5, XV-8, XV I-1, XV I-3, XV II-1, XV II-3, XV III-1, XV III-2, XV III-3, XIV-10, XX-8, XXI-1, XXII-1, XXII-6, or XXIII-1, the same preferable results were obtained.

EXAMPLE 5

Samples ① to ⑩ of multilayer color photographic paper were prepared with layers as hereinbelow described and with changing the coating amount of silver, the magenta coupler, and the cyan coupler, respectively, on each paper laminated on both side with polyethylene. Coating solutions were prepared as follows:

Preparation of the first-layer coating solution

To a mixture of 19.1 g of yellow coupler (ExY and 4.4 g of an image-dye stabilizer (Cpd-1), 27.2 ml of ethyl acetate and 7.7 ml (8.0 g) of a high boiling solvent (Solv-1) were added and dissolved. The resulting solution was emulsified and dispersed in 185 ml of 10% aqueous gelatin solution containing 8 ml of a 10% solution of sodium dodecylbenzensulfonate. Each of emulsions EM7 and EM8 was mixed with the above-obtained emulsified and dispersed solution and dissolved, and the concentration of gelatin in the mixture was adjusted to obtain the composition shown below, thereby preparing the first-layer coating solution. The second to the seventh-layer coating solutions were prepared in the same manner as the first coating solution. As a gelatin hardener for the respective layers, the sodium salt of 1-oxy-3,5-dichloro-2-triazine was used. As a thickener, a compound (Cpd-2) was used.

Compositions of layers

The composition of each layer is shown below. Each ingredient is indicated in g/m$^2$ of a coating amount, but the coating amount of silver halide is shown in g/m$^2$ in terms of silver.

Supporting base: Polyethylene-laminated paper (a white pigment, $TiO_2$, and a bluish dye, ultramarine, were included in the first-layer side of the polyethylene-laminated film).

| | |
|---|---|
| First layer: Blue sensitive layer | |
| Monodisperse silver chlorobromide emulsion (EM7) spectral-sensitized by sensitizing dye (ExS-1) | 0.15 |
| Monodisperse silver chlorobromide emulsion (EM8) spectral-sensitized by sensitizing dye (ExS-1) | 0.15 |
| Gelatin | 1.86 |
| Yellow coupler (ExY) | 0.82 |
| Image-dye stabilizer (Cpd-2) | 0.19 |
| Solvent (Solv-1) | 0.35 |
| Second layer: Color-mix-preventing layer | |
| Gelatin | 0.99 |
| Color-mix inhibitor (Cpd-3) | 0.08 |
| Third layer: Green-sensitive emulsion layer | |
| Monodisperse silver chlorobromide emulsion (EM9) spectral-sensitized by sensitizing dye (ExS-2, -3) | 0.12 |
| Monodisperse silver chlorobromide emulsion (EM10) spectral-sensitized by sensitizing dye (ExS-2, -3) | 0.24 |
| Gelatin | 1.24 |
| Magenta coupler (ExM) | see Table 4 |
| Image-dye stabilizer (Cpd-4) | 0.25 |
| Image-dye stabilizer (Cpd-5) | 0.12 |
| Solvent (Solv-2) | 0.25 |
| Fourth layer: UV Absorbing layer | |
| Gelatin | 1.60 |
| UV absorbent (Cpd-6/Cpd-7/Cpd-8 = 3/2/6 in wt. ratio) | 0.70 |
| Color-mix inhibitor (Cpd-9) | 0.05 |
| Solvent (Solv-3) | 0.42 |
| Fifth layer: Red-sensitive emulsion layer | |
| Monodisperse silver chlorobromide emulsion (EM11) spectral sensitized by sensitizing dye (ExS-4, -5) | 0.07 |
| Monodisperse silver chlorobromide emulsion (EM12) spectral-sensitized by sensitizing dye (ExS-4, -5) | 0.16 |

-continued

| | |
|---|---|
| Gelatin | 0.92 |
| Cyan coupler (ExC-1) | see Table 4 |
| Cyan coupler (ExC-2) | see Table 4 |
| Image-dye stabilizer (Cpd-7/Cpd-8/Cpd-10 = 3/4/2 in wt. ratio) | 0.17 |
| Polymer for dispersion (Cpd-11) | 0.14 |
| Solvent (Solv-1) | 0.20 |
| Sixth layer: UV-absorbing layer | |
| Gelatin | 0.54 |
| UV absorbent (Cpd-6/Cpd-8/Cpd-10 = 1/5/3 in wt. ratio) | 0.21 |
| Solvent (Solv-4) | 0.08 |
| Seventh layer: Protective layer | |
| Gelatin | 1.33 |
| Acryl-modified copolymer of poly(vinyl alcohol) (modification degree: 17%) | 0.17 |
| Liquid paraffin | 0.03 |

For preventing irradiation, dyes (Cpd-12 and -13) were used.

In addition, Alkanol XC (tradename, made by Dupont) and sodium alkylbenzensulfonate were used as auxiliary agents for emulsification and dispersion, and succinate ester and Magnefac F-120 (tradename, made by Dainippon Ink) were added to each layer as coating aids.

The silver halide emulsions used in this Example were as follows:

| Emulsion | Shape | Grain size (μm) | Br Content (mol %) | Deviation coefficient* |
|---|---|---|---|---|
| EM7 | Cubic | 1.1 | 1.0 | 0.10 |
| EM8 | Cubic | 0.8 | 1.0 | 0.10 |
| EM9 | Cubic | 0.45 | 1.5 | 0.09 |
| EM10 | Cubic | 0.34 | 1.5 | 0.09 |
| EM11 | Cubic | 0.45 | 1.5 | 0.09 |
| EM12 | Cubic | 0.34 | 1.6 | 0.10 |

*The values show distribution degree of grains as follows: standard deviation/av. grain size The chemical formulas of compounds used are as follows:

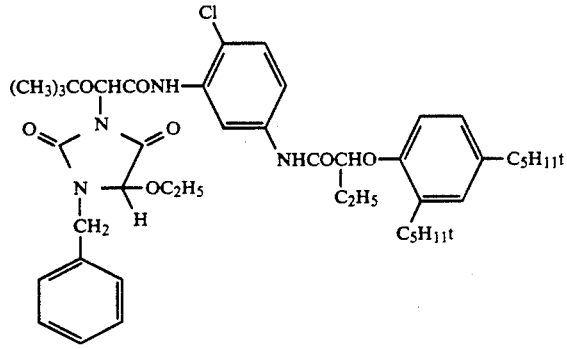

ExY

| | |
|---|---|
| see Table 4 | ExM |
| see Table 4 | ExC-1 |
| see Table 4 | ExC-2 |

-continued
ExS-1
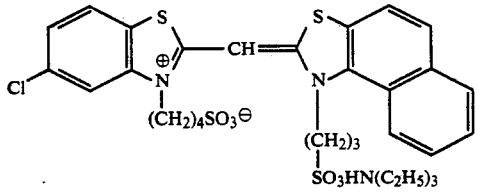
ExS-2
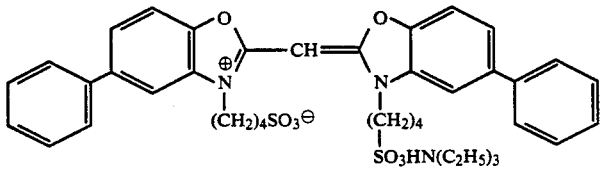
ExS-3
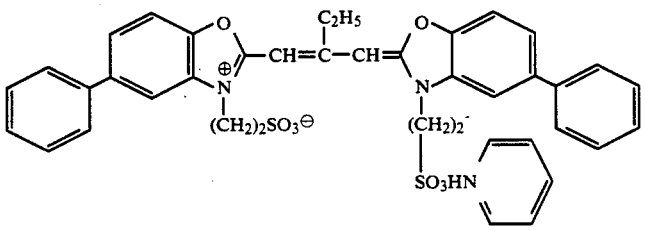
ExS-4
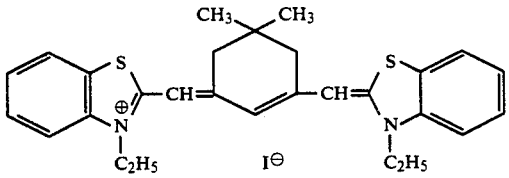
ExS-5
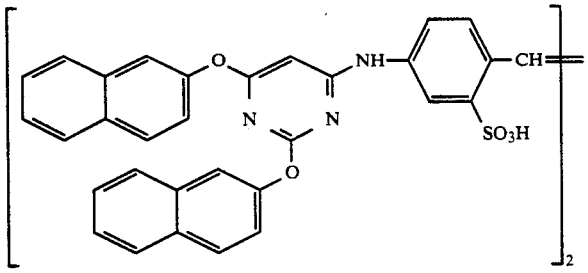
Cpd-1
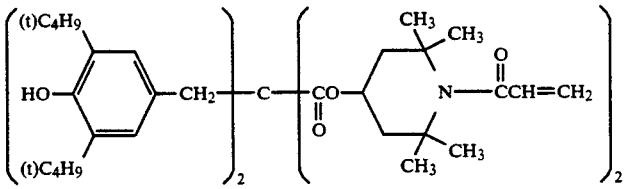
Cpd-2
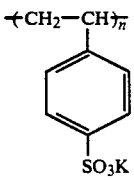

-continued
Cpd-3
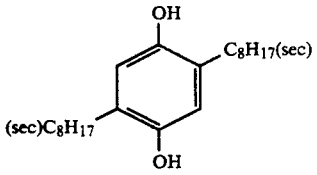
Cpd-4
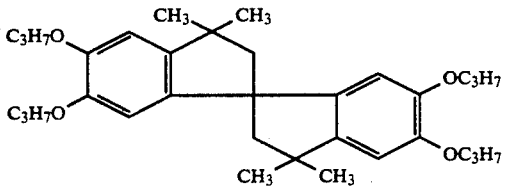
Cpd-5
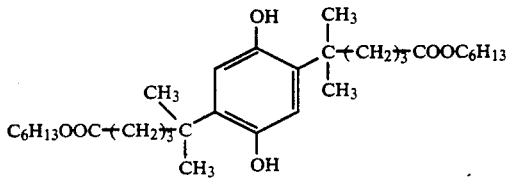
Cpd-6
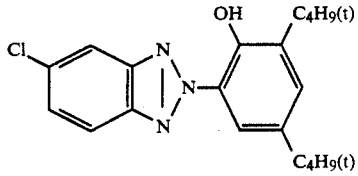
Cpd-7
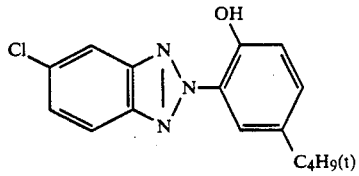
Cpd-8
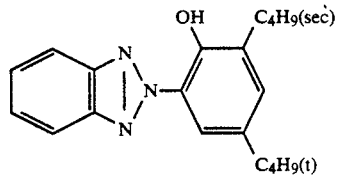
Cpd-9
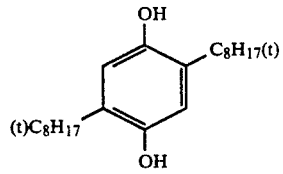
Cpd-10
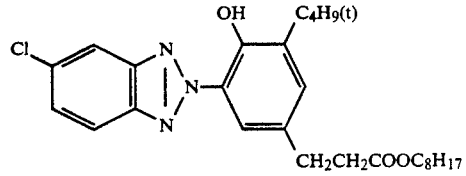
Cpd-11
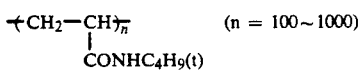
(n = 100~1000)

-continued

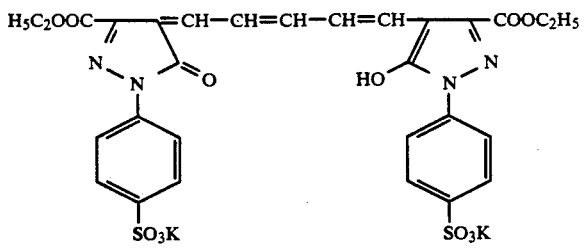

Cpd-12

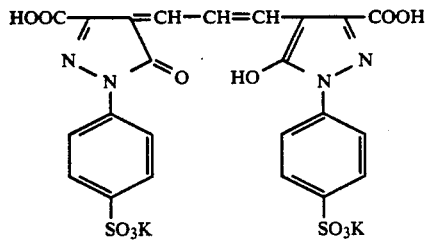

Cpd-13

| | |
|---|---|
| Dibutyl phthalate | Solv 1 |
| Trioctyl phosphate | Solv 2 |
| Trinonyl phosphate | Solv 3 |
| Tricresyl phosphate | Solv 4 |

The coating amount in terms of silver ($g/m^2$) of each layer was changed as follows:

| Layer | Emulsion | Sample A | B | C | D |
|---|---|---|---|---|---|
| First Layer | EM7 | 0.18 | 0.15 | 0.12 | 0.11 |
| | EM8 | 0.18 | 0.15 | 0.12 | 0.11 |
| Third Layer | EM9 | 0.12 | 0.12 | 0.12 | 0.11 |
| | EM10 | 0.24 | 0.24 | 0.20 | 0.19 |
| Fifth Layer | EM11 | 0.09 | 0.07 | 0.07 | 0.05 |
| | EM12 | 0.16 | 0.16 | 0.16 | 0.12 |
| Summary | | 0.97 | 0.89 | 0.79 | 0.69 |

The above-described photographic materials A, B, C, and D were subjected to an imagewise light exposure, and then to continuous processing (running test) using a paper-processor in the following processing process, until the replenisher-amount of the developing solution equaled twice the volume of the color-developing tank.

| Processing step | Temperature (°C.) | Time (sec.) | Replenisher Amount (ml)* | Tank (l) |
|---|---|---|---|---|
| Color-developing | 39 | 60 | 30 | 4 |
| Bleach-fixing | 30–36 | 45 | 215 | 4 |
| Stabilizing (1) | 30–37 | 20 | — | 2 |
| Stabilizing (2) | 30–37 | 20 | — | 2 |
| Stabilizing (3) | 30–37 | 20 | — | 2 |
| Stabilizing (4) | 30–37 | 20 | 250 | 2 |
| Drying | 70–85 | 60 | | |

*Replenisher amount per $m^2$ of photographic material (Stabilizing steps were carried out in a four-tank cascade mode from tank of stabilizing (4) toward tank of stabilizing (1).)

The composition of the processing solutions were as follows:

| | Tank solution | Replenisher |
|---|---|---|
| Color-Developing Solution | | |
| Water | 800 ml | 800 ml |
| Ethylenediaminetetraacetate | 5.0 g | 5.0 g |
| 5,6-Dihydroxybenzene-1,2,4-trisulfonate | 0.3 g | 0.3 g |
| Triethanoleamine | 8.0 g | 8.0 g |
| Sodium chloride | 8.4 g | 0.0 g |
| Potassium carbonate | 25 g | 25 g |
| N-Ethyl-N-(β-methanesulfonamido-methyl)-3-methyl-4-aminoaniline sulfate | 5.0 g | 15.0 g |
| Diethylhydroxylamine | 4.2 g | 10.0 g |
| Fluorescent brightening agent (4,4-diaminostilbene series) | 2.0 g | 5.0 g |
| Water to make | 1000 ml | 1000 ml |
| pH (25° C.) | 10.25 | 11.00 |
| Bleach-Fixing Solution (both the tank solution and replenisher are the same) | | |
| Water | | 400 ml |
| Ammonium thiosulfate (70%) | | 100 ml |
| Sodium sulfite | | 17 g |
| Iron (III) ammonium ethylenediamine-tetraacetate | | 55 g |
| Disodium ethylenediaminetetraacetate | | 5 g |
| Glacial acetic acid | | 9 g |
| Water to make | | 1000 ml |
| pH (25° C.) | | 5.40 |
| Stabilizing Solution (both the tank solution and replenisher are the same) | | |
| Formalin (37%) | | 0.1 g |
| Formalin-sulfic acid adduct | | 0.7 g |
| 5-Chloro-2-methyl-4-isothiazoline-3-on | | 0.02 g |
| 2-Methyl-4-isothiazoline-3-on | | 0.01 g |
| Copper sulfate | | 0.005 g |
| Aqueous ammonia (28%) | | 2.0 ml |
| Water to make | | 1000 ml |
| pH (25° C.) | | 4.0 |

As in Example 1, changes of Dmax, Dmin, and sensitivity after running test and yellow stain after processing were tested and the results are shown in Table 4.

TABLE 4

| Processing Process<br>Coated Sample | | ①<br>A | ②<br>C | ③<br>D | ④<br>A | ⑤<br>B | ⑥<br>C | ⑦<br>D | ⑧<br>D | ⑨<br>D | ⑩<br>D |
|---|---|---|---|---|---|---|---|---|---|---|---|
| Magenta Coupler (ExM) mol/m² | | M-74 | M-75 | M-76 | M-37 | M-37 | M-37 | M-37 | M-37 | M-37 | M-37 |
| Cyan Coupler (ExC-1) mol/m² | | C-1 | C-1 | C-1 | C-1 | C-1 | C-1 | C-1 | C-1 | C-1 | C-28 |
| Yellow Coupler (ExC-2) mol/m² | | C-3 | C-3 | C-3 | C-3 | C-3 | C-3 | C-3 | C-9 | C-27 | C-27 |
| Remarks | | Comparative Example | | | This Invention | | | | | | |
| GL | Δ $D_{min}$ | +0.10 | +0.11 | +0.09 | +0.02 | +0.01 | 0 | 0 | 0 | +0.01 | +0.02 |
| | Δ $D_{max}$ | +0.30 | +0.33 | +0.31 | +0.10 | +0.08 | +0.02 | +0.03 | +0.02 | +0.02 | +0.03 |
| | Δ Sensitivity | −0.23 | −0.19 | −0.22 | −0.03 | −0.02 | −0.02 | −0.01 | −0.01 | −0.02 | −0.03 |
| GL | Δ $D_{min}$ | +0.09 | +0.09 | +0.08 | +0.01 | +0.01 | 0 | 0 | 0 | +0.01 | +0.01 |
| | Δ $D_{max}$ | +0.28 | +0.27 | +0.29 | +0.08 | +0.08 | +0.01 | +0.01 | +0.02 | +0.06 | +0.11 |
| | Δ Sensitivity | −0.19 | −0.19 | −0.20 | −0.04 | −0.03 | −0.01 | −0.01 | −0.01 | −0.02 | −0.03 |
| Yellow Stain after Processing | | +0.19 | +0.25 | +0.29 | +0.13 | +0.13 | +0.06 | +0.06 | +0.07 | +0.10 | +0.13 |

(C-27)

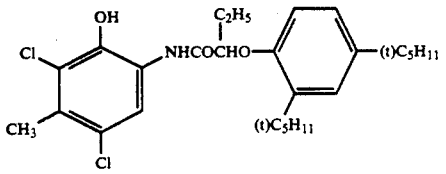

(C-28)

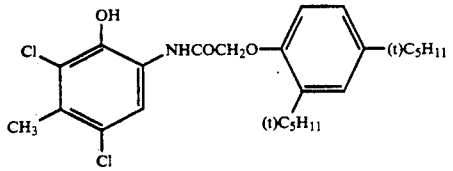

As is apparent from the resulting in Table 4, when a photographic material not containing the magenta coupler represented by formula (I) is used, as shown in the processing processes ① to ③, there were caused large changes in minimum density, maximum density, and sensitivity of magenta coloring layer (GL) between the beginning and the end of the running test and the increase of yellow stain after processing was remarkable.

However, when a photographic material containing the magenta coupler represented by formula (I) is used, as shown in the processing processes ④ to ⑩, the changes in the photographic characteristics of magenta coloring layer (GL) during the running were apparently decreased, and the yellow stain after processing was remarkably restrained. Thus according to the present invention it becomes to be possible to attain both good stability in a processing and good preservability of image at the same time, remarkably decreasing the replenishing amount of color-developing solution.

Further, it is understood that, as shown in the processing processes ④ to ⑦, coating amount less than 0.8 g/m² in terms of silver in the photographic material is more preferable in the present invention, in view of the stability of photographic characteristics during continuous processing and the image-stability after processing.

Further, as shown in the photographic materials ⑦ and ⑧, it is understood that the photographic material containing the cyan coupler represented by formula (C) is more preferable in the present invention, in view of the stability of photographic characteristics during continuous processing, in particular, the processing-stability of cyan coloring layer (RL).

EXAMPLE 6

When a process was repeated in the same manner as in Example 5, except that the magenta coupler M-37 of the photographic material ⑦ was changed to M-3, M-13, M-23, M-37, M-39, M-43, M-45 and M-61, respectively, the same preferable results were obtained in all cases.

EXAMPLE 7

When a process was repeated in the same manner as in Example 5, except that the cyan couplers C-1 and C-3 of the photographic material ⑦ were changed to C-9 and C-10, the preferable results were obtained.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for continuous processing of a silver halide color photographic material with a color developer containing at least one aromatic primary amine color-developing agent in an amount of about 0.5 to 10 g/l of color developer, which comprises processing, after exposure to light, a silver halide color photographic material (1) which has a green-sensitive layer, a blue-sensitive layer and a red-sensitive layer, which layers have a silver chloride content of 95 mol % or more, (2) which has a total silver halide coating amount in terms of silver from 0.4–0.7 g/m² and (3) which contains at least one pyrazoloazole magenta coupler represented by the following formula (I):

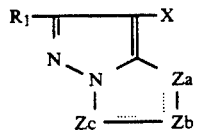

wherein $R_1$ represents a hydrogen atom or a substituent; X represents a hydrogen atom or a group that can be split-off by a coupling reaction with the oxidation product of the aromatic primary amine-developing agent; Za, Zb, and Zc each represents methine, a substituted methine, =N—, or —NH—; one of the Za—Zb bond and the Zb—Zc bond is a double bond, and the other is a single bond; and when the Zb—Zc bond is a carbon-carbon double bond, it may be part of an aromatic ring, and the compound may form a dimer or a higher polymer via $R_1$ or X; and when Za, Zb, or Zc is a substituted methine, the compound may form a dimer or a higher polymer via said substituted methine, with the color developer wherein the replenishing amount of the color developer is from 20 to 120 ml per $m^2$ of said silver halide photographic material, and wherein the color developer contains benzyl alcohol in an amount of 2 ml/l or below.

2. The method as claimed in claim 1, wherein the compound represented by formula (I) is selected from the compounds represented by formulae (II), (III), (IV), (V), (VI), (VII):

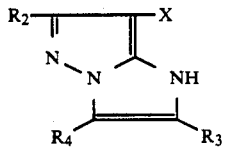
(II)

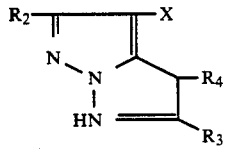
(III)

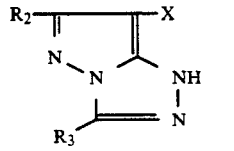
(IV)

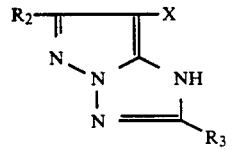
(V)

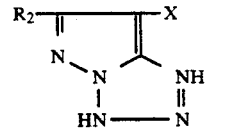
(VI)

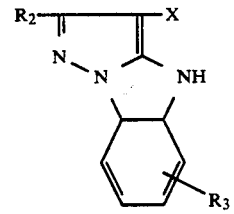
(VII)

wherein $R_2$, $R_3$, and $R_4$ each represent a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, a heterocyclic thio group, an alkoxycarbonylamino group, an aryloxycarbonylamino group, a sulfonamido group, a carbamoyl group,an acyl group, a sulfamoyl group, a sulfonyl group, a sulfinyl group, an alkoxycarbonyl group, or an aryloxycarbonyl group, and X represents a hydrogen atom, a halogen atom, a carboxy group, or a group that links to the carbon atom in the coupling position through an oxygen atom, a nitrogen atom, or a sulfur atom, and that can be split-off by a coupling reaction.

3. The method as claimed in claim 1, wherein the layer of a high-silver-chloride emulsion is a greensensitive emulsion layer.

4. The method as claimed in claim 1, wherein the color developer is substantially free from sulfite ion.

5. The method as claimed in claim 1, wherein the color developer is substantially free from hydroxylamine.

6. The method as claimed in claim 1, wherein the color developer contains an organic preservative.

7. The method as claimed in claim 1, wherein the color developer contains at least one organic preservative selected from the group consisting of hydroxylamines, hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, polyamines, and condensed ring-type amines, but wherein the color developer is substantially free from hydroxylamine.

8. The method as claimed in claim 1, wherein the aromatic primary amine color developing agent is a member selected from the group consisting of p-phenylenediamines.

9. The method as claimed in claim 1, wherein the color developer contains (i) at least one preservative selected from the group consisting of hydroxylamines, hydroxamic acids, hydrazines, hydrazides, phenols, α-hydroxyketones, α-aminoketones, saccharides and (ii) at least one preservative selected from monoamines, diamines, polyamines, quaternary ammonium salts, nitroxy radicals, alcohols, oximes, polyamines, and condensed ring-type amines, but wherein the color developer is substantially free from hydroxylamine.

10. The method as claimed in claim 1, wherein the color developer contains (i) at least one preservative selected from the group consisting of hydroxylamines represented by formula (VIII):

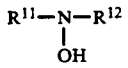
Formula (VIII)

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom, and hydrazines and hydrazides represented by formula (X):

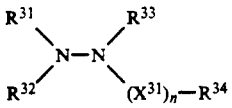

Formula (X)

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $X^{31}$ represents a divalent group selected from —CO—, —$SO_2$, and

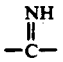

n is 0 or 1; and $R^{34}$ represents a hydroxy group, a hydroxyamino group, a substituted or unsubstituted alkyl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group, and (ii) at least one preservative selected from monoamines represented by formula (XIV):

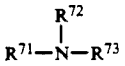

Formula (XIV)

wherein $R^{71}$, $R^{72}$, and $R^{73}$ each represent a hydrogen atom, an alkyl group, an alkenyl group, an aryl group, an aralkyl group, or a heterocyclic group, and $R^{71}$ and $R^{72}$, $R^{71}$ and $R^{73}$, or $R^{72}$ and $R^{73}$ may bond together to form a nitrogen-containing heterocyclic group, and amines having a condensed ring represented by formula (XXIII):

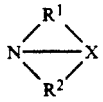

Formula (XXIII)

wherein X represents a trivalent group of atoms necessary to complete a condensed ring, and $R^1$ and $R^2$ each represent an alkylene group, an arylene group, an alkenylene group, or an arylkylene group, and $R^1$ and $R^2$ may be the same or different, but wherein the color developer is substantially free from hydroxylamine.

11. The method as claimed in claim 1, wherein the amount of the aromatic primary amine developing agent to be used is about 0.1 g to about 20 g per liter of developer.

12. The method as claimed in claim 1, wherein the pH of the color developer is in the range of 9 to 12.

13. The method as claimed in claim 1, wherein the replenishing amount of the color developer is 30 to 100 ml per $m^2$ of the silver halide photographic material.

14. The method as claimed in claim 1, wherein the processing after exposure to light with the color developer is carried out at 30° to 40° C. for 20 sec. to 5 min.

15. The method as claimed in claim 1, wherein the red-sensitive emulsion layer of the silver halide color photographic material comprises a cyan coupler represented by formula (C):

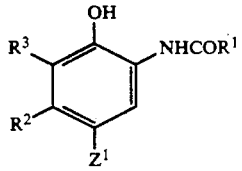

Formula (C)

wherein $R^1$ represents an alkyl group, cycloalkyl group, aryl group, amino group, or heterocyclic group, $R^2$ represents an acylamino group or alkyl group containing more than 2 carbon atoms, $R^3$ represents a hydrogen atom, halogen atom, alkyl group, or alkoxy group, $R^3$ may form a ring by being combined with $R^2$, and $Z^1$ represents a hydrogen atom, halogen atom, or group capable of splitting-off by a coupling reaction with an oxidized aromatic primary amine color developing agent.

16. The method as claimed in claim 1, wherein the color developer contains at least one compound represented by the following formula (VIII):

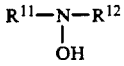

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, $R^{11}$ and $R^{12}$ do not represented hydrogen atoms at the same time, and $R^{11}$ and $R^{12}$ may be bond together to form a heterocyclic ring with the nitrogen atom.

* * * * *